US007538495B2

(12) United States Patent
Wada et al.

(10) Patent No.: US 7,538,495 B2
(45) Date of Patent: May 26, 2009

(54) FLUORESCENT LAMP, BACKLIGHT APPARATUS, AND MANUFACTURING METHOD OF FLUORESCENT LAMP

(75) Inventors: Hideki Wada, Takatsuki (JP); Hirofumi Yamashita, Moriguchi (JP); Shogo Toda, Takatsuki (JP); Yoshio Manabe, Katano (JP); Takashi Maniwa, Takatsuki (JP); Nozomu Hashimoto, Osaka (JP); Kazuhiro Matsuo, Takatsuki (JP); Katsumi Itagaki, Kyoto (JP)

(73) Assignee: Panasonic Corporation, Osaka (JP)

( * ) Notice: Subject to any disclaimer, the term of this patent is extended or adjusted under 35 U.S.C. 154(b) by 513 days.

(21) Appl. No.: 11/237,989

(22) Filed: Sep. 28, 2005

(65) Prior Publication Data

US 2006/0076895 A1 Apr. 13, 2006

(30) Foreign Application Priority Data

| | | |
|---|---|---|
| Oct. 7, 2004 | (JP) | 2004-295271 |
| Nov. 18, 2004 | (JP) | 2004-334635 |
| Dec. 7, 2004 | (JP) | 2004-354678 |

(51) Int. Cl.
*H01J 17/16* (2006.01)
*H01J 61/35* (2006.01)

(52) U.S. Cl. ..... 313/635; 313/484; 313/486; 313/489

(58) Field of Classification Search ..... 313/484–487, 313/489, 635
See application file for complete search history.

(56) References Cited

U.S. PATENT DOCUMENTS

| | | | | |
|---|---|---|---|---|
| 5,258,689 | A * | 11/1993 | Jansma et al. | 313/489 |
| 6,078,136 | A * | 6/2000 | Sica | 313/493 |
| 2003/0034731 | A1 * | 2/2003 | Masahiro et al. | 313/567 |
| 2005/0062423 | A1 * | 3/2005 | Shibahara et al. | 313/634 |
| 2005/0285537 | A1 * | 12/2005 | Inagaki et al. | 313/635 |
| 2006/0103315 | A1 * | 5/2006 | Vossen et al. | 313/635 |

FOREIGN PATENT DOCUMENTS

| | | | |
|---|---|---|---|
| JP | 01-112651 | | 5/1989 |
| JP | 07099040 | A * | 4/1995 |
| JP | 07296776 | A * | 11/1995 |
| JP | 09-286981 | | 11/1997 |
| JP | 10125282 | A * | 5/1998 |
| JP | 10-188900 | | 7/1998 |
| JP | 2003-123691 | | 4/2003 |
| JP | 2004319468 | A * | 11/2004 |

* cited by examiner

*Primary Examiner*—Joseph L Williams
*Assistant Examiner*—Kevin Quarterman

(57) ABSTRACT

A fluorescent lamp including a glass bulb, a protection layer formed on an inner surface of the glass bulb, and a phosphor layer formed on a surface of the protection layer. The surface of the protection layer that is in contact with the phosphor layer has cracks. The bulk density of the metal oxide particles in the protection layer 32 is 80% or more. The surface of the protection layer 32 has 20 to 200 cracks per millimeter in a tube axis direction. The average particle diameter of the metal oxide particles is in the range from 0.01 μm to 1 μm. The thickness of the protection layer is in the range from 0.5 μm to 5 μm.

19 Claims, 20 Drawing Sheets

Prior Art

FIG.16

| B \ A | 0 | 0.1 | 0.2 | 0.3 | 0.4 | 0.5 | 0.6 |
|---|---|---|---|---|---|---|---|
| 0 | | NG 1 | NG 1 | NG 1 | NG 1 | NG 1 | NG 1 |
| 0.1 | NG 1 | NG 1 | NG 1 | OK | OK | OK | OK |
| 0.2 | NG 1 | NG 1 | OK | OK | OK | OK | NG 2 |
| 0.3 | NG 1 | OK | OK | OK | OK | NG 2 | NG 2 |
| 0.4 | NG 1 | OK | OK | OK | NG 2 | NG 2 | NG 2 |
| 0.5 | NG 1 | OK | OK | NG 2 | NG 2 | NG 2 | NG 2 |
| 0.6 | NG 1 | OK | NG 2 | NG 2 | NG 2 | NG 2 | NG 2 |
| 0.7 | NG 1 | NG 2 | NG 2 | NG 2 | NG 2 | NG 2 | NG 2 |

FLUORESCENT LAMP, BACKLIGHT APPARATUS, AND MANUFACTURING METHOD OF FLUORESCENT LAMP

This application is based on application Nos. 2004-295271, 2004-334635, and 2004-354678 filed in Japan, the content of which is hereby incorporated by reference.

BACKGROUND OF THE INVENTION (1) Field of the Invention

The present invention relates to a fluorescent lamp, a backlight apparatus including the fluorescent lamp, and a manufacturing method of the fluorescent lamp.

(2) Description of the Related Art

In recent years, various types of fluorescent lamps have been developed for use. The fluorescent lamps contain mercury in a glass bulb constituting an arc tube, where mercury radiates ultraviolet light when it obtains energy from electrons. However, reaction of the mercury with the glass bulb (hereinafter, the reaction is referred to as "mercury reaction") may cause a defect such as the change of color of the glass bulb or the consumption of the mercury that brings a short life of the lamp.

As a result, technologies for restricting the mercury reaction by forming a protection layer between the glass bulb and the phosphor layer have been proposed (see for example, Japanese Laid-Open Patent Application No. 1-112651 and Japanese Laid-Open Patent Application No. 2003-123691). FIG. 1 is an enlarged photo of a cross section of a conventional arc tube taken along a plane that includes the tube axis. FIG. 1 shows that a protection layer 102 and a phosphor layer 104 are stacked on a glass bulb 100.

Meanwhile, the protection layer 102 is composed of particles of a metal oxide, and gaps "A" exist between the particles. The inventors of the present invention found that when the gaps A exist in the protection layer 102, visible light is reflected diffusedly at interfaces that have different refractive indexes, thus decreasing the luminous flux of the arc tube. Also, from the viewpoint of restricting the mercury reaction, it is necessary to make the protection layer 102 thick enough. Here, if the protection layer 102 is made thick for restricting the mercury reaction, the luminous flux decreases due to the above-mentioned diffused reflection. Conversely, if the protection layer 102 is made thin enough to ensure the luminous flux, the mercury reaction is not restricted well.

Considering a method for solving the above-mentioned problems, the inventors of the present invention first came up with an idea of enhancing the bulk density of the metal oxide particles in the protection layer. With this method, it is possible to reduce the gaps between the particles in the protection layer 102 and restrict the diffused reflection, and to restrict the mercury reaction without reducing the luminous flux since it can make the layer more thick than in the conventional technologies.

The inventors of the present invention manufactured pre-production samples of the fluorescent lamps in which the bulk density of the particles in the protection layer 102 has been increased compared with the conventional technologies, and confirmed with the pre-production samples that the luminous flux does not decrease if the thickness of the protection layer 102 is increased to a certain extent.

However, the inventors found a new problem in the pre-production samples of fluorescent lamps that the difference in chromaticity is observed for the entire arc tube since the phosphors are distributed unevenly.

SUMMARY OF THE INVENTION

The object of the present invention is therefore to provide a fluorescent lamp with restricted difference in chromaticity for the entire arc tube, and to provide a backlight apparatus including the fluorescent lamp and a manufacturing method of the fluorescent lamp.

While studying the cause of the difference in chromaticity, the inventors of the present invention found that as the bulk density of the metal oxide particles in the protection layer increases, the surface of the protection layer that is in contact with the phosphor layer becomes smooth. When the glass bulb is erected vertically and applied with a phosphor suspension, the phosphors of different colors are distributed unevenly due to the difference in specific gravity between the phosphors, and the difference in chromaticity occurs between the areas of the surface of the arc tube. This is because when the contact surface of the protection layer with the phosphor layer is smooth, the binder in the phosphor suspension becomes easy to flow downward. This also makes the phosphors in the phosphor suspension easy to flow downward. Here, the phosphors of different colors flow down at different speeds due to the difference in the specific gravity between them, causing the phosphors to be distributed unevenly.

The problems are solved and the above object is fulfilled by a fluorescent lamp comprising: a glass bulb; a protection layer formed on an inner surface of the glass bulb; and a phosphor layer formed on a surface of the protection layer, wherein the surface of the protection layer that is in contact with the phosphor layer has cracks.

With the above-stated construction in which cracks are formed in the surface of the protection layer that is in contact with the phosphor layer, part of the binder contained in the phosphor suspension enters the cracks after the phosphor suspension is applied. Generally, the binder is high in viscosity. Therefore, when the binder partially enters the cracks, the binder becomes difficult to flow downward. This makes the phosphors of different colors, which are covered with the binder, difficult to flow downward, reduces the difference of the flow-down speed among them that is generated due to the difference of the specific gravity among them, and reduces the tendency of the phosphors to be distributed unevenly.

In the above-described fluorescent lamp, it is preferable that the surface of the protection layer has 20 to 200 cracks per millimeter in a tube axis direction.

If the number of the cracks in the surface of the protection layer that is in contact with the phosphor layer in the tube axis direction is less than 20 [per mm], the above-stated action of the binder that entered the cracks is not enough, which makes the phosphors difficult to be distributed evenly. If the number of the cracks is more than 200 [per mm], a more amount of mercury may enter the cracks to cause mercury reaction.

In the above-described fluorescent lamp, it is preferable that a basic component of the protection layer is metal oxide particles, and a bulk density of the metal oxide particles in the protection layer is 80% or more.

It is preferable that bulk density of the metal oxide particles is 80% or more. This is because if the bulk density of the metal oxide particles is less than 80%, there are many gaps between particles, and the luminous flux decreases. It should be noted here that the "bulk density of the particles" is the ratio, represented by percentage, of a volume of the particles to a unit volume.

In the above-described fluorescent lamp, it is preferable that an average particle diameter of the metal oxide particles is in the range from 0.01 μm to 1 μm.

This is because if the particles have an average particle diameter of more than 1 μm, it is difficult to make the bulk density of the particles 80% or more, and it is difficult to manufacture particles with particle diameter of less than 0.01 μm.

In the above-described fluorescent lamp, it is preferable that the thickness of the protection layer is in the range from 0.5 μm to 5 μm.

This is because if the protection layer is less than 0.5 μm in thickness, it is difficult to form the cracks in the contact surface of the protection layer, and if the protection layer is more than 5 μm in thickness, the luminous flux of the lamp decreases. It should be noted here that the thickness of the protection layer is defined by the average thickness of the protection layer at the center of the glass bulb.

In the above-described fluorescent lamp, it is preferable that a surface roughness of the surface of the protection layer that is in contact with the phosphor layer is 200 nm or less. This is because if the surface roughness is more than 200 nm, the diffused reflection of visible light increases, which reduces the brightness.

In the above-described fluorescent lamp, it is preferable that the phosphor layer includes: a plurality of phosphor particles; and a linking agent that links the phosphor particles with each other, and contains yttrium oxide and alkaline-earth metal borate.

With the above-stated construction in which the linking agent that surrounds and links the phosphor particles with each other is composed of yttrium oxide, which has tolerance to bombardment by mercury ions, and alkaline-earth metal borate that is superior than yttrium oxide in the linking force, it is possible to restrict the reduction in brightness over time and to restrict the removal of the phosphor layer from the inner surface of the glass bulb.

In the above-described fluorescent lamp, it is preferable that the alkaline-earth metal borate is CBB.

In the above-stated construction, among various alkaline-earth metal borates, CBB is used. Compared with the case where CBBP is used, this makes it possible to reduce the adsorption of mercury, and as a result of this, further restrict the reduction in brightness.

In the above-described fluorescent lamp, it is preferable that the following relationships are satisfied, where a total weight of the phosphor particles is presumed to be 100, a ratio of the yttrium oxide to the total weight is represented by A, and a ratio of the alkaline-earth metal borate to the total weight is represented by B: $0.1 \leqq A \leqq 0.6$; and $0.4 \leqq (A+B) \leqq 0.7$.

With the above-stated construction in which the ratios of the yttrium oxide and the alkaline-earth metal borate to the total weight and their mixture ratio are defined as indicated above, it is possible to obtain the advantageous effect of restricting the reduction in brightness that is attributed to the coloring of the liking agent during the manufacturing processes, in addition to the advantageous effect of restricting the removal of the phosphor layer.

In the above-described fluorescent lamp, it is preferable that a pair of cold-cathode-type electrodes are provided in the glass bulb, and particles of the metal oxide are distributed and attached to surfaces of at least part of phosphor particles that constitute the phosphor layer.

It was confirmed through experiments that with the above-stated construction, the fluorescent lamp has a higher luminous flux maintenance factor than conventional cold-cathode fluorescent lamps. It is considered that when the surfaces of the phosphor particles are completely covered with a metal oxide, mercury becomes difficult to attach to the phosphor particles, thus improving the luminous flux maintenance factor, but the metal oxide itself is transformed due to an unknown cause during the lamp lighting, which gradually makes it difficult for ultraviolet light to reach the phosphor particles, thus reducing the luminous flux maintenance factor.

That is to say, in the above-stated construction of the present invention, particles of the metal oxide are sparsely distributed and attached to surfaces of phosphor particles without completely covering the phosphor particles with the metal oxide. It is considered that the construction enables the luminous flux maintenance factor to be improved since it restricts the reduction of the luminous flux maintenance factor that occurs due to the attachment of mercury to the phosphor particles and the transformation of the metal oxide.

In the above-described fluorescent lamp, it is preferable that the particles of the metal oxide are distributed approximately evenly over entire surfaces of the phosphor particles.

When the particles of the metal oxide are unevenly distributed on the surfaces of phosphor particles, mercury is apt to attach to areas of the phosphor particles in which almost no metal oxide exists, which reduces the luminous flux maintenance factor. In contrast, when the particles of the metal oxide are substantially evenly distributed on the entire surfaces of phosphor particles, mercury becomes difficult to attach to the surfaces of phosphor particles as a whole. It is considered that this construction of the present invention restricts the reduction of the luminous flux maintenance factor.

In the above-described fluorescent lamp, it is preferable that when a coverage ratio of the particles of the metal oxide to the surfaces of phosphor particles is represented by P, the following relationship is satisfied: $0<P<76$.

It was confirmed through experiments that the lamp of the present invention in which the coverage ratio P(%) is in the range $0<P<76$ has an improved luminous flux maintenance factor than conventional cold-cathode fluorescent lamps in which the coverage ratio is 0% or 100%. It should be noted here that the coverage ratio is the ratio of the metal oxide particles to the surfaces of the phosphor particles in area. Also, although it is preferable that the coverage ratio P is in the range $0<P<76$ for each phosphor particle in the phosphor layer, it is acceptable that for some phosphor particles, the coverage ratio is 0% or more than 76%.

In the above-described fluorescent lamp, it is preferable that an average particle diameter of the particles of the metal oxide is in a range from 0.01 μm to 0.1 μm inclusive.

This is because if the particles have an average particle diameter of more than 0.1 μm, the amount of ultraviolet light that reaches the phosphor particles is reduced, and it is difficult to manufacture particles with particle diameter of less than 0.01 μm.

In the above-described fluorescent lamp, it is preferable that the metal oxide is magnesium oxide.

It was confirmed through experiments that the luminous flux maintenance factor is improved when magnesium oxide (MgO) is used as the metal oxide in the above-stated construction.

In the above-described fluorescent lamp, it is preferable that the at least part of phosphor particles includes a phosphor particle that emits blue light upon being excited.

Among the phosphor particles in the phosphor layer that respectively emit red, green, and blue light upon being excited, mercury is most apt to attach to particles of the blue phosphor. The inventors of the present invention found that this is the major cause of the reduction of the luminous flux maintenance factor. It is accordingly possible to improve the luminous flux maintenance factor by attaching the metal oxide particles at least to the surfaces of the particles of the blue phosphor in the above stated construction.

The above object is also fulfilled by a backlight apparatus that includes, as a light source, any of the above-stated fluorescent lamps. This makes it possible to provide a backlight apparatus that has less color difference.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 16 shows the results of the shock test;

DESCRIPTION OF THE PREFERRED EMBODIMENT

The following describes a cold-cathode fluorescent lamp and a backlight apparatus in the embodiments of the present invention, with reference to the drawings.

Figure 1:
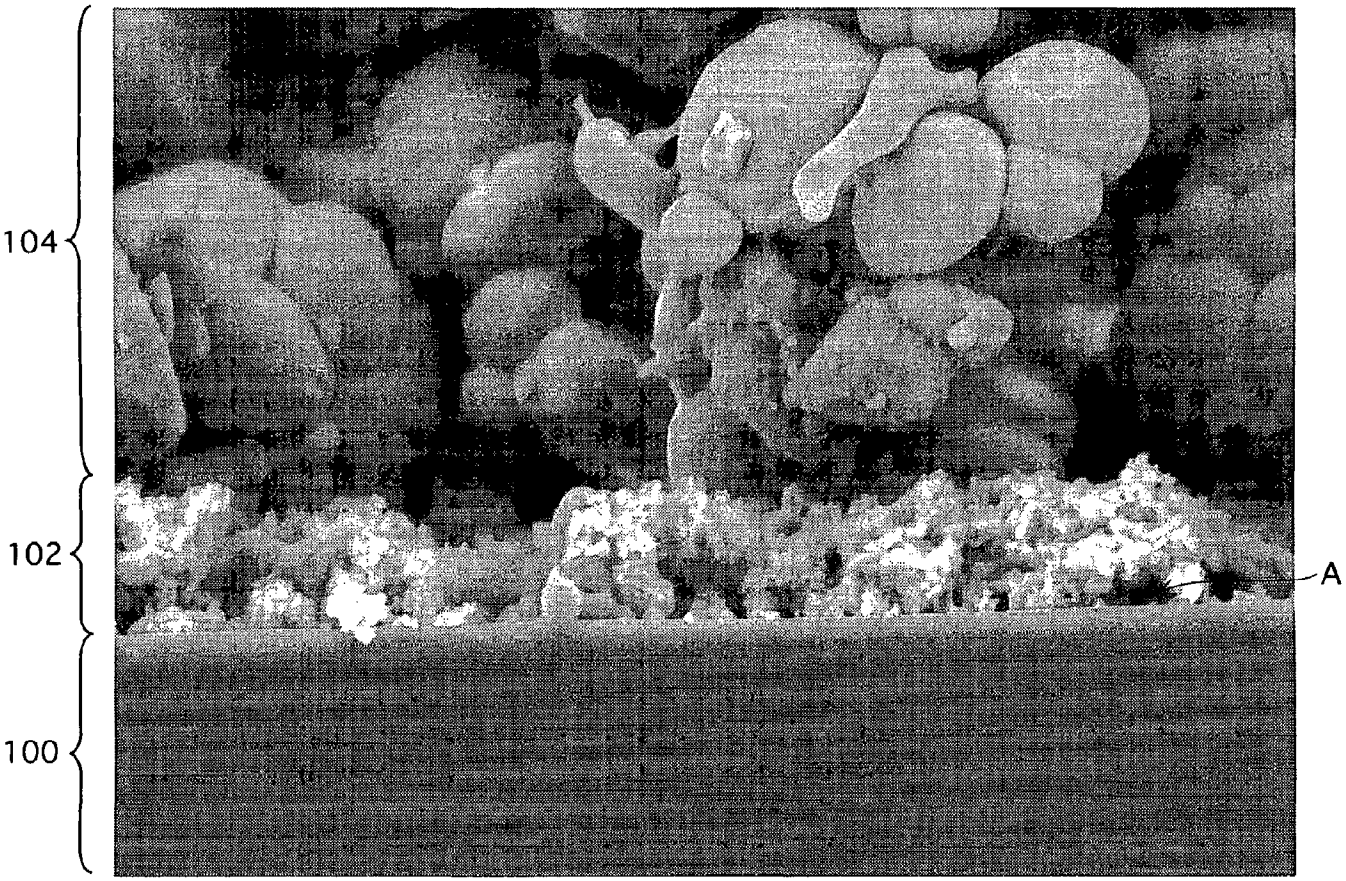
FIG. 1 is a photo showing the conformation of the protection layer in a conventional fluorescent lamp.
Figure 2:
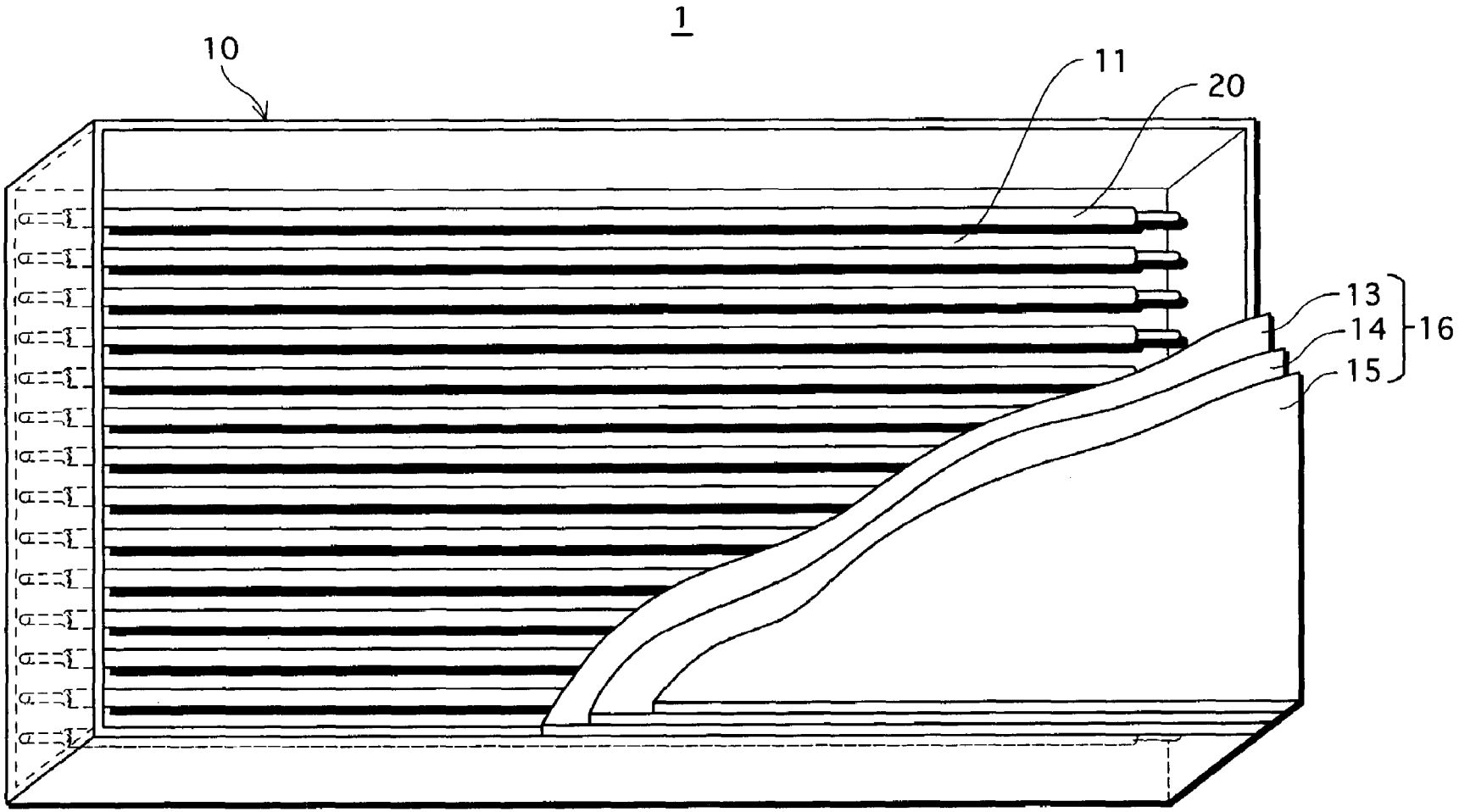
FIG. 2 is a perspective view showing the construction of a backlight apparatus in Embodiment 1 for a liquid crystal television.

First, the construction of the backlight apparatus in the present embodiment will be described. FIG. 2 is a perspective view that shows the construction of a backlight apparatus 1 in the present embodiment for a liquid crystal television with an aspect ratio of 16:9. In FIG. 2, part of a front panel 16 is cut away to show the structure inside.

As shown in FIG. 2, the backlight apparatus 1 includes a plurality of cold-cathode fluorescent lamps (hereinafter merely referred to as "lamps") 20, a rectangular container 10 for housing the lamps 20, and a front panel 16 that covers an opening of the rectangular container 10.

The rectangular container 10 is made of, for example, polyethylene terephthalate (PET). A metal such as silver is vapor-deposited on the inner surfaces 11 of the rectangular container 10.

Each of the lamps 20 is in a shape of a straight tube. In the present embodiment, 14 lamps 20 are arranged in the rectangular container 10 conforming to the direct-below type and are connected electrically in parallel. The construction of the lamps 20 will be described later.

The opening of the rectangular container 10 is covered with the front panel 16 that is translucent and is a stack of a diffusion plate 13, a diffusion sheet 14, and a lens sheet 15. The rectangular container 10 is hermetically sealed to prevent dust or the like from coming into it.

The diffusion plate 13 and the diffusion sheet 14 of the front panel 16 are provided for the purpose of scattering and diffusing the light emitted from the lamps 20. The lens sheet 15 is provided for the purpose of aligning rays of light in the direction of a normal line of the lens sheet 15. The rays of light emitted from the lamps 20 go forward and illuminate the entire surface (light-emitting surface) of the front panel 16 evenly.

Embodiment 1

Figure 3:
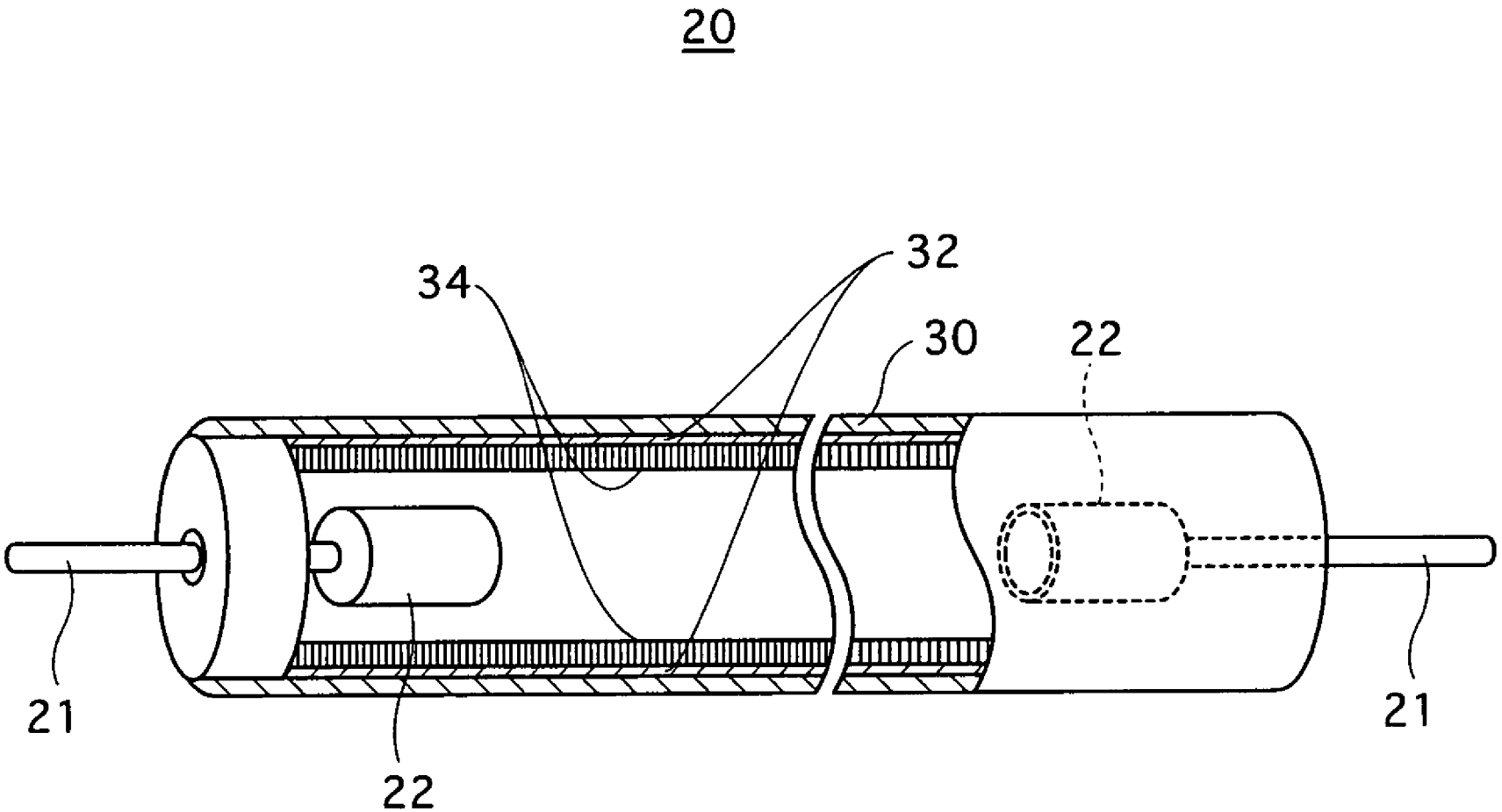
FIG. 3 is a cutaway view showing an outline of the construction of a cold-cathode fluorescent lamp.

Now, the construction of a lamp 20 in Embodiment 1 will be described with reference to FIG. 3. FIG. 3 is a cutaway view that shows an outline of the construction of the lamp 20.

The lamp 20 includes a glass tube 30 that is in a shape of a straight tube, is circular in the shape of cross section, and is hermetically sealed by lead wires 21 at both ends thereof.

The glass tube 30 is made of borosilicate glass, and is 340 mm in length, 4.0 mm in outer diameter, and 3.0 mm in inner diameter. A protection layer 32 is formed on the inner surface of the glass tube 30 to protect the surface from the mercury reaction. On the protection layer 32, a phosphor layer 34 is formed. The construction of the protection layer 32 will be described later.

The phosphor layer 34 includes three types of rare-earth phosphors: red phosphor ($Y_2O_3$: $Eu^{3+}$); green phosphor ($LaPO_4$: $Ce^{3+}$, $Tb^{3+}$); and blue phosphor ($BaMg_2Al_{16}O_{27}$: $Eu^{2+}$). The phosphor layer 34 also contains a linking agent.

Each of the lead wires 21 is formed by linking an inner lead wire made of tungsten with an outer lead wire made of nickel, and the glass tube 30 is hermetically sealed by the inner lead wires at both ends thereof.

Electrodes 22 are respectively connected to ends of the lead wires 21 that are disposed within the glass tube 30, by laser welding or the like. The electrodes 22 are what are called hollow-type electrodes and are in the shape of a cylinder with a bottom, and are formed by processing nickel bars, niobium bars or the like. The reason why the hollow type is adopted for the electrodes 22 is that the hollow type is effective in suppressing the sputtering at electrodes caused by the discharge when the lamp is lighted.

The glass tube 30 is filled with, for example, a certain amount of rare gases (Ar 5% and Ne 95%) with a gas pressure of 60 Torr.

The protection layer 32 is composed of fine particles of yttria ($(Y_2O_3)$), and the bulk density of the particles is approximately 90%. Here, it is preferable that the bulk density is 80% or more. This is because if the bulk density is less than 80%, there are many gaps between particles, and the translucency of the protection layer reduces due to the diffused reflection.

It is preferable that the average particle diameter of the yttria particles is in the range from 0.01 μm to 1 μm. This is because it is difficult to manufacture yttria particles with particle diameter of less than 0.01 μm, and because if the particles have particle diameter of more than 1 μm, it is difficult to cause the particles to have the bulk density of 80% or more.

Figure 4:
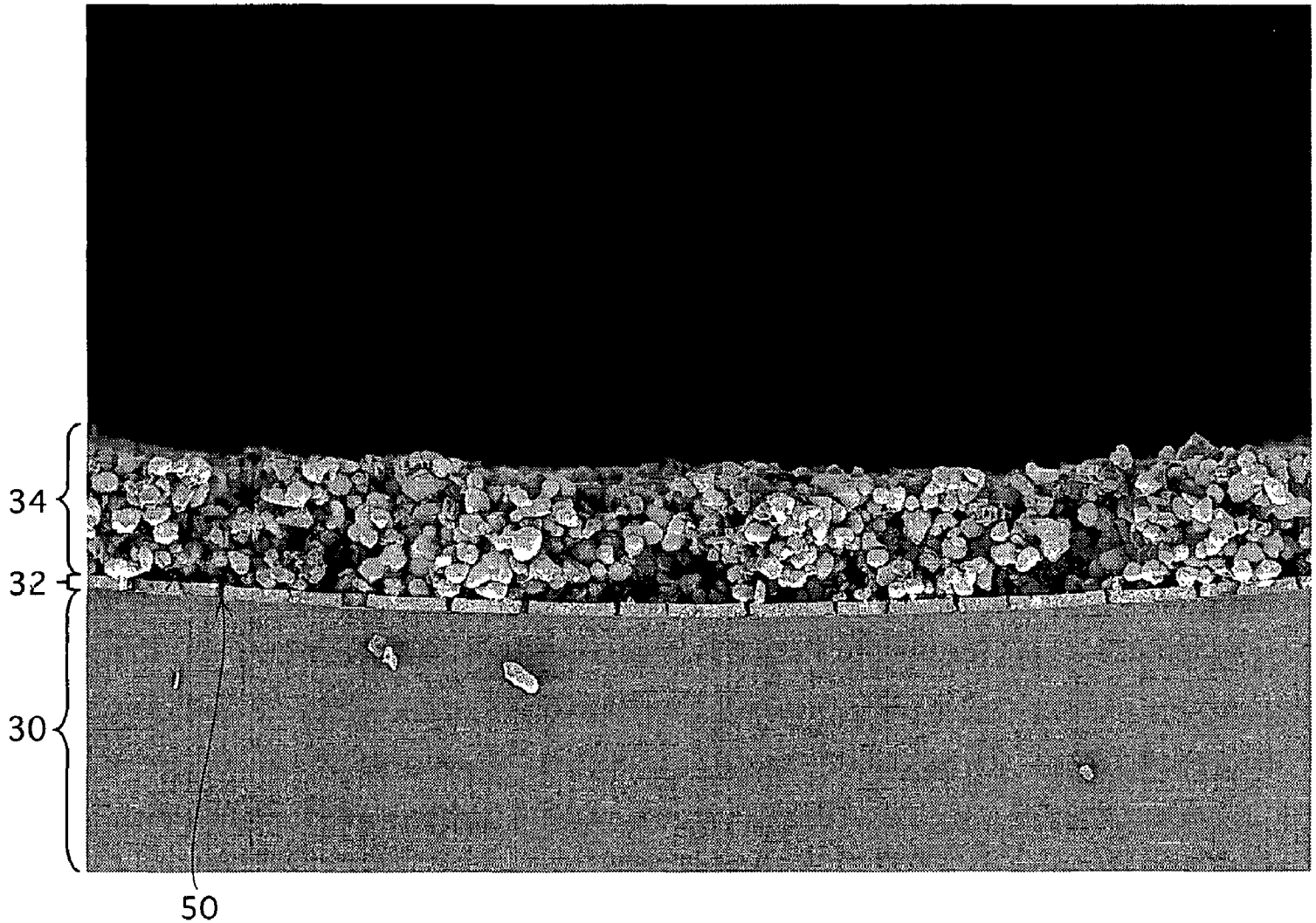
FIG. 4 is an enlarged photo of a cross section of the arc tube.

FIG. 4 is an enlarged photo of a cross section of the arc tube that indicates that the protection layer 32 is formed on the inner surface of the glass tube 30, and that the phosphor layer 34 is formed on the protection layer 32. As shown in FIG. 4, cracks 50 are formed in a surface of the protection layer 32 that is in contact with the phosphor layer 34.

There are approximately 100 cracks 50 per unit length [mm] in a cross section of the glass tube 30 taken along a plane perpendicular to the tube axis. The number of cracks 50 can be measured by counting the cracks that are observed in the cross section of the arc tube that was photographed by a scanning electron microscope (SEM). Similarly, there are approximately 100 cracks 50 per unit length [mm] in a cross section of the glass tube 30 taken along a plane that includes the tube axis.

Figure 5:
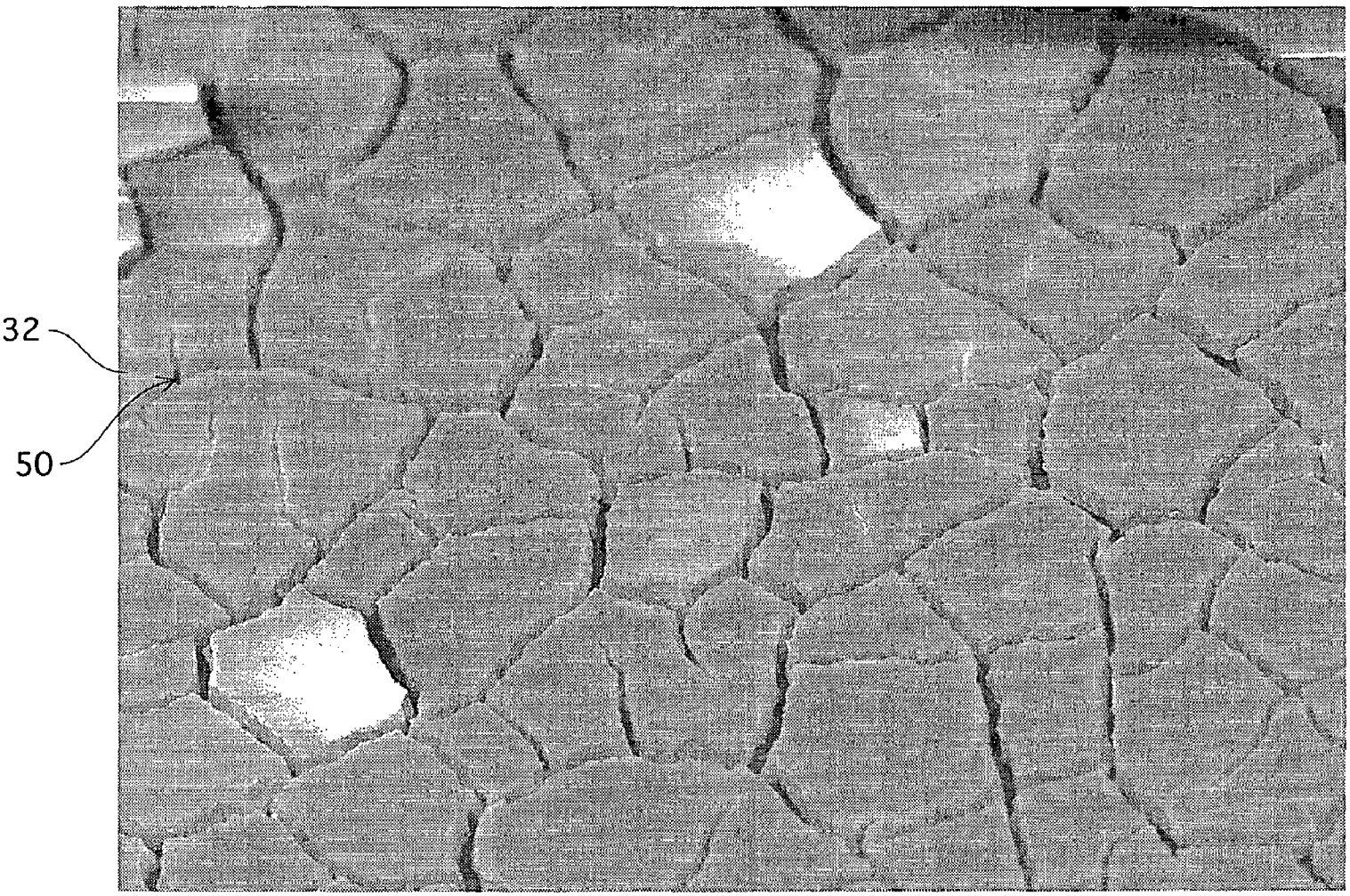
FIG. 5 is a photo of a surface of the protection layer 32 that is in contact with the phosphor layer 34.

FIG. 5 is a photo of a surface of the protection layer 32 that is in contact with the phosphor layer 34. The photo indicates that the cracks 50 are formed in the surface of the protection layer 32. As shown in FIG. 5, a lot of cracks 50 are formed in a shape of a turtle back.

It is preferable, from the viewpoint of restricting the reduction of brightness due to the diffusion of visible light, it is preferable that the surface roughness of the contact surface of the protection layer 32 is 200 nm or less. It is more preferable that the surface roughness of the contact surface of the protection layer 32 is 100 nm or less. It is further preferable that the surface roughness of the contact surface of the protection layer 32 is 50 nm or less. The surface roughness mentioned here is what is called an arithmetic average roughness (Ra) (Japanese Industrial Standard B 0601:1994).

Figure 6:
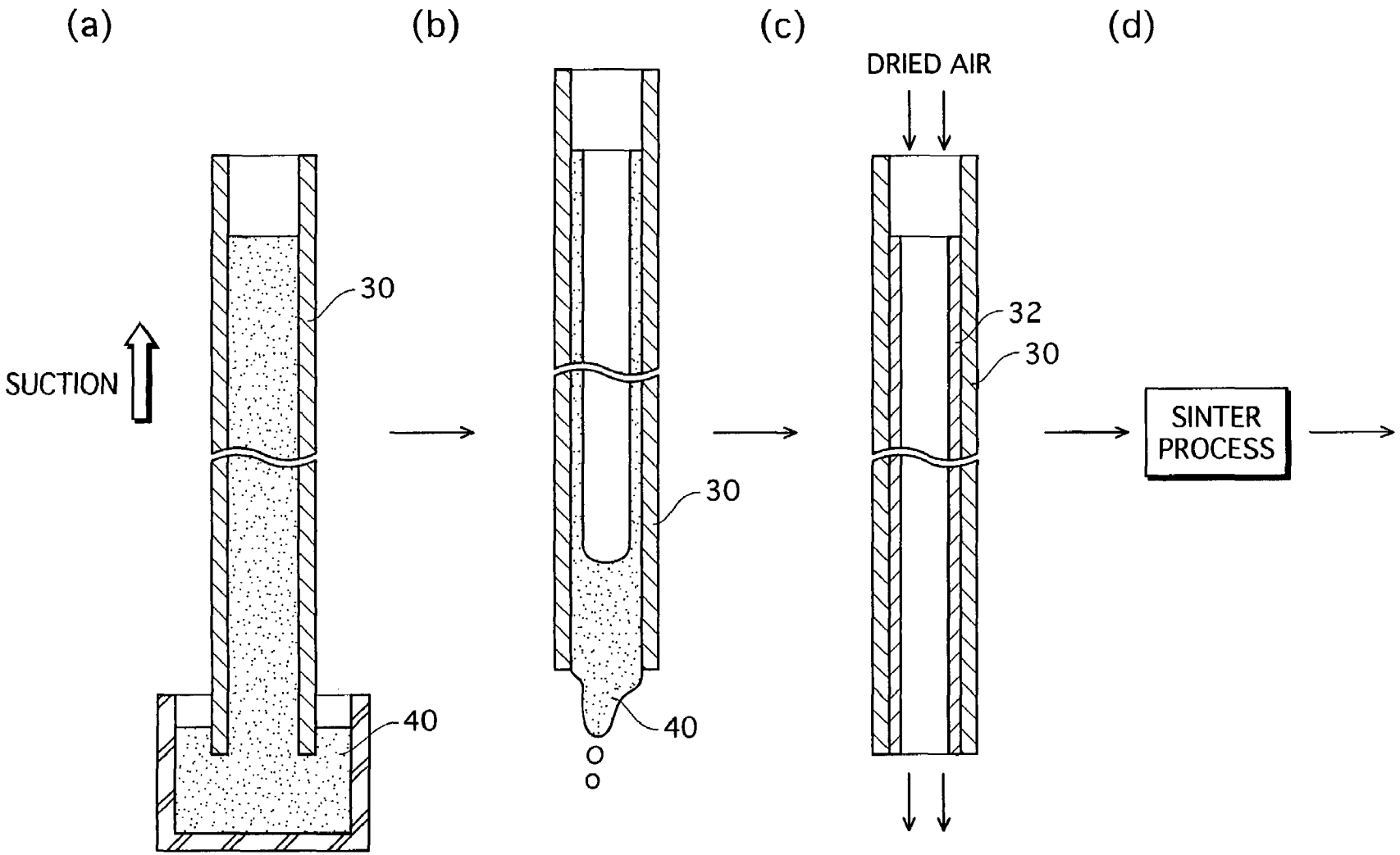
FIG. 6 shows procedures for forming the protection layer.
Figure 7:
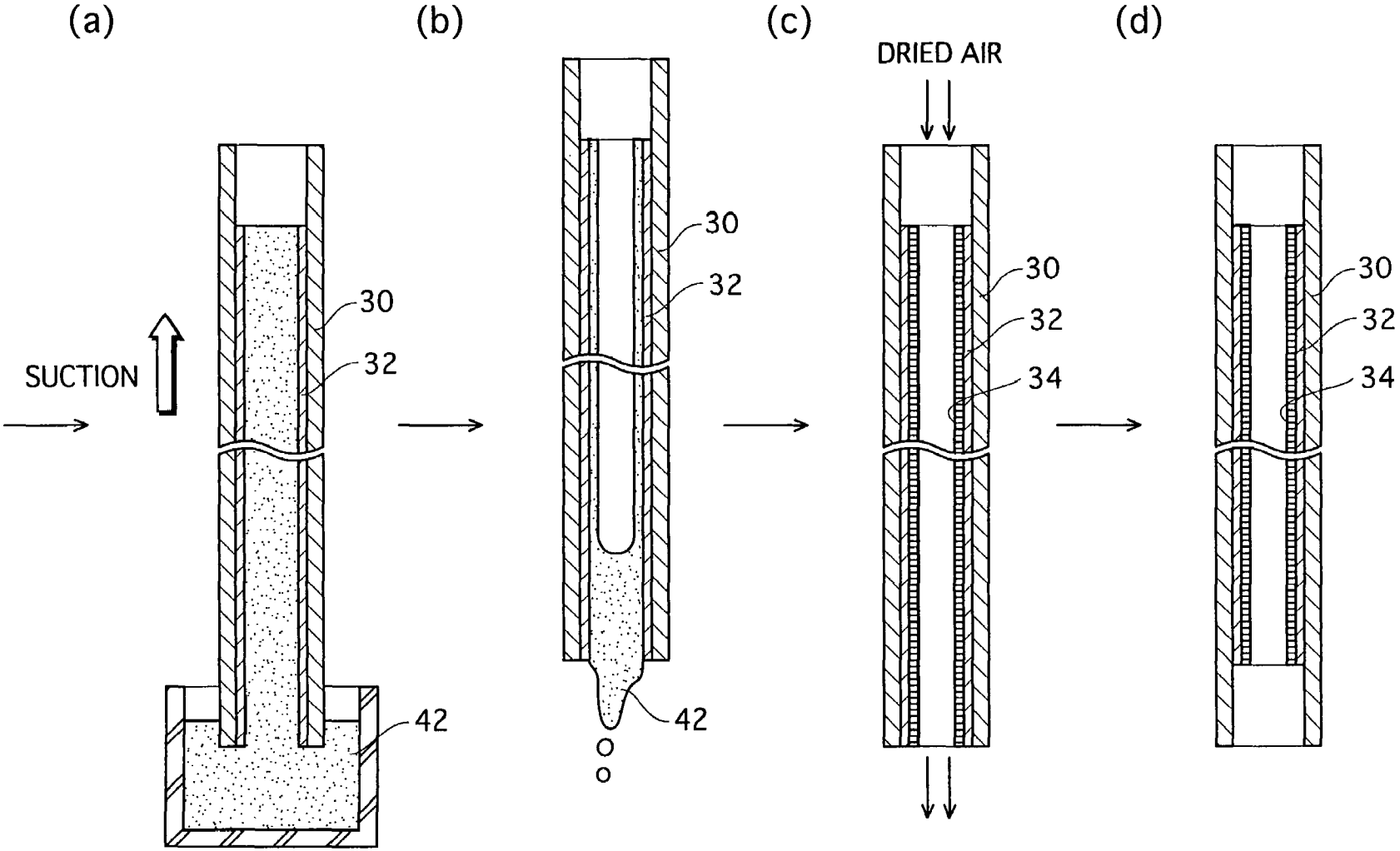
FIG. 7 shows procedures for forming the phosphor layer.

The following describes, with reference to FIGS. 6 and 7, a method for forming the protection layer 32 and the phosphor layer 34 on the inner surface of the glass tube 30. FIG. 6 shows procedures for forming the protection layer 32. FIG. 7 shows procedures for forming the phosphor layer 34.

First, the glass tube 30 made of borosilicate glass, a protection layer solution 40, and a phosphor suspension 42 are prepared.

The protection layer solution 40 is prepared by distributing yttria particles into a solution that contains an appropriate surface active agent.

The phosphor suspension 42 is prepared as a mixture of phosphors of red, green and blue, a binder, a linking agent, and an organic solvent.

First, as shown in portion (a) of FIG. 6, the glass tube 30 is erected vertically with an opening of its lower end being in contact with the surface of the protection layer solution 40. Then, a suction device (not illustrated) is used to draw the protection layer solution 40 into the glass tube 30. When the solution in the glass tube 30 reaches a certain height, the suction is stopped. Then the glass tube 30 is pulled up from the protection layer solution 40 so that the solution goes out of the glass tube 30 through the opening at the lower end. This allows the protection layer solution 40 to attach to the inner surface of the glass tube 30 as a layer.

After this, as shown in portion (c) of FIG. 6, the protection layer solution 40 attached to the inner surface of the glass tube 30 is dried by introducing a dried air into the glass tube 30 from an opening at the upper end. Then, as shown in portion (d) of FIG. 6, the glass tube 30 is sintered at a predetermined temperature so that organic constituents remaining in the protection layer solution 40 are decomposed. This allows the protection layer 32 to be formed on the inner surface of the glass tube.

Here, cracks 50 are formed over the entire surface of the protection layer 32 (being in contact with the phosphor layer 34) as shown in FIG. 5 when the glass tube 30 is sintered, for example, under the following conditions: the sintering temperature is 630° C.; and the temperature rises from the normal temperature to the sintering temperature at the speed of 1.7° C./sec to 2.0° C./sec.

After this, as shown in portion (a) of FIG. 7, the glass tube 30 is erected vertically with an opening of its lower end being in contact with the surface of the phosphor suspension 42, and the phosphor suspension 42 is drawn into the glass tube 30. Then the drawing is stopped and the glass tube 30 is pulled up from the phosphor suspension 42 as shown in portion (b) of FIG. 7 so that the suspension goes out of the glass tube 30. This allows the phosphor suspension 42 to be applied to the surface of the protection layer 32.

After this, as shown in portion (c) of FIG. 7, the phosphor suspension 42 attached to the surface of the protection layer 32 is dried by introducing a dried air into the glass tube 30 from an opening at the upper end. This allows the phosphor layer 34 to be formed on the protection layer 32. Then, as shown in portion (d) of FIG. 7, unnecessary lower part of the phosphor layer 34 and the protection layer 32 is removed from inside the glass tube 30. After this, the lamp 20 is completed after disposing the electrodes 22 with a certain method, and introducing rare gas and mercury into the glass bulb.

With the above-described method in which the phosphor suspension 42 is applied to the glass tube 30 that has been erected vertically, conventionally, green and red phosphors that are large in specific gravity move downward to a certain extent, during a time period from the application to the drying of the phosphor suspension 42. Also, the ratio of the blue phosphor increases at an upper portion of the glass bulb. This generates a difference in chromaticity between the areas of the surface of the arc tube. In a cold-cathode fluorescent lamp that is used as a light source for a backlight apparatus for a liquid crystal display or the like, the presence of a large difference of chromaticity causes a problem that, for example, only one side of the screen is tinged with blue. For this reason, it is necessary to reduce the difference of chromaticity.

The inventors of the present invention studied the cause of the occurrence of the difference in chromaticity between areas in the surface of the arc tube, and found that the problem occurs since the contact surface of the protection layer with the phosphor layer is made smooth, which happens when the bulk density of the metal oxide particles in the protection layer is increased. This is because when the contact surface of the protection layer with the phosphor layer is smooth, the binder in the phosphor suspension becomes easy to flow downward. This also makes the phosphors in the phosphor suspension easy to flow downward. Here, the phosphors of different colors flow down at different speeds due to the difference in the specific gravity between them, causing the phosphors to be distributed unevenly.

In the present embodiment, after the protection layer 32 is applied and dried during the process of forming the protection layer 32, the protection layer 32 is sintered under certain conditions (sintering temperature, temperature rising speed) As a result, the cracks 50 are formed in the surface of the protection layer 32 (the surface that is in contact with the phosphor layer). The reason why the phosphors are distributed evenly when the cracks 50 are formed is as follows.

When the cracks 50 are formed in the surface of the protection layer 32 that is in contact with the phosphor layer 34, part of the binder contained in the phosphor suspension 42 enters the cracks 50 after the phosphor suspension 42 is applied. Generally, the binder is high in viscosity. Therefore, when the binder partially enters the cracks 50, the binder becomes difficult to flow downward. This makes the phosphors of different colors, which are covered with the binder, difficult to flow downward. This reduces the difference in the flow-down speed between the phosphors of different colors, which is caused by the difference in the specific gravity between the phosphors. And this reduces the tendency of the phosphors to be distributed unevenly.

The inventors of the present invention also examined the appropriate density of the cracks 50. Here, they focused attention on the number of the cracks 50 in the tube axis direction since the phosphor suspension 42 is applied to the glass tube 30 that is erected vertically.

As a result of the examination, if the number of the cracks 50 in the surface of the protection layer 32 that is in contact with the phosphor layer 34 is less than 20 [per mm] in the tube axis direction, the binder that entered the cracks 50 does not act enough as described above, which makes it difficult to distribute the phosphors evenly. They also found that if the number of the cracks 50 in the surface of the protection layer 32 that is in contact with the phosphor layer 34 is more than 200 [per mm] in the tube axis direction, mercury may enter the cracks 50 to cause the mercury reaction. It is accordingly preferable that the number of the cracks 50 in the surface of the protection layer 32 that is in contact with the phosphor layer 34 is in the range from 20 to 200 [per mm] in the tube axis direction. It should be noted here that the number of the cracks can be adjusted by adjusting the sintering temperature or the temperature rising speed.

The inventors of the present invention also examined the appropriate thickness of the protection layer 32. As a result of the examination, they found that if the thickness of the protection layer 32 is less than 1 μm, the protection layer is relatively thin to the particle diameter of the metal oxide that constitutes the protection layer, which makes the cracks difficult to form. Also, if the thickness of the protection layer 32 is more than 5 μm, the light transmission is reduced, which reduces the luminous flux. It is accordingly preferable that the thickness of the protection layer 32 is in the range from 1 μm to 5 μm.

It is further preferable that the width of the crack is in the range from 0.1 μm to 5 μm. This is because if the width is less than 0.1 μm, the above-stated action of the binder that entered the cracks 50 is not obtained enough, and if the width is more than 5 μm, mercury tends to enter the cracks 50.

The following describes an example of the present embodiment (referred to as invention example) in comparison with a comparative example.

The invention example of the present embodiment is 1.8 μm in thickness of the protection layer 32, 90% in the bulk density of the metal oxide particles in the protection layer 32, and 100 cracks 50 are formed per mm in the tube axis direction.

The comparative example is 1 μm in thickness of the protection layer 32, 70% in the bulk density of the metal oxide particles in the protection layer 32, and no crack is formed.

Figure 8:
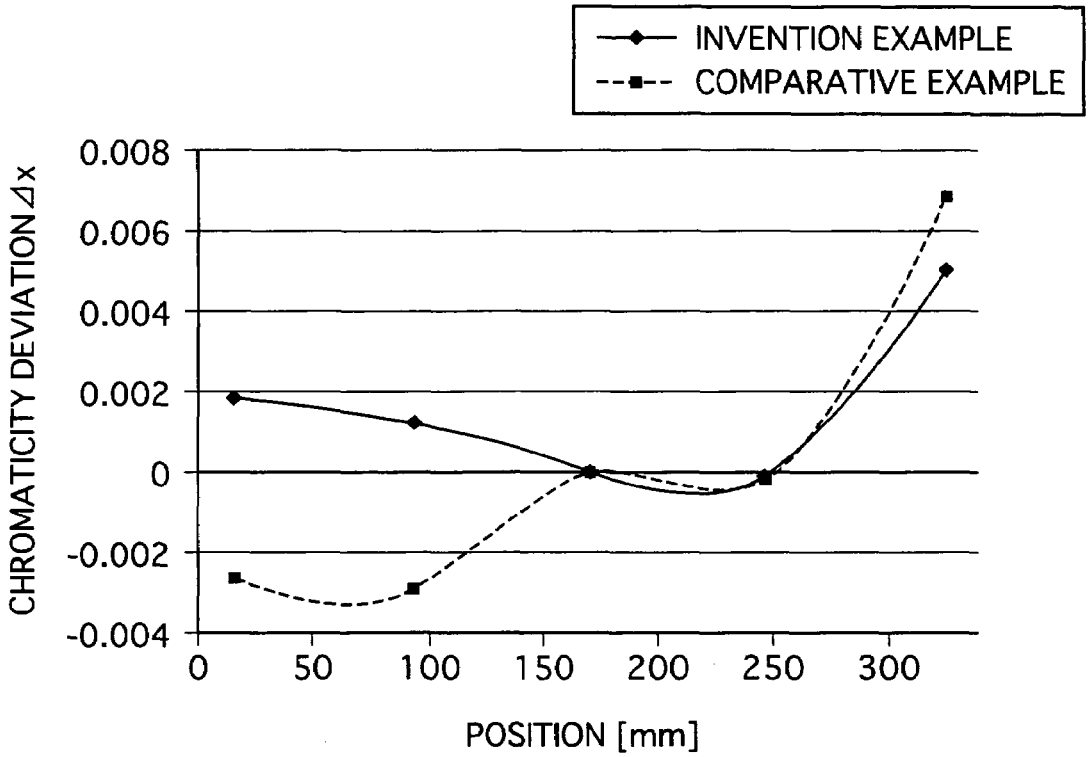
FIG. 8 is a plot of chromaticity deviation Δx and positions in the lamp in terms of the invention example and the comparative example.
Figure 9:
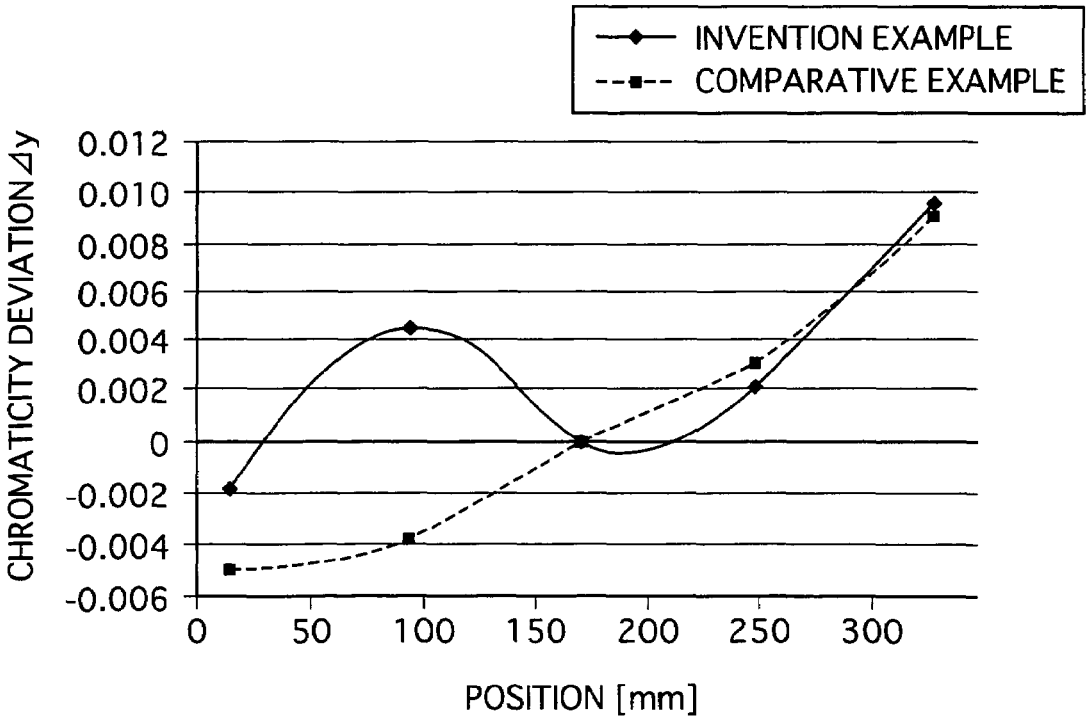
FIG. 9 is a plot of chromaticity deviation Δy and positions in the lamp in terms of the invention example and the comparative example.

FIGS. 8 and 9 show chromaticity deviation at various positions in the arc tube. The vertical axis of the graph indicates the chromaticity deviation in the x or y direction on the chromaticity diagram. The horizontal axis of the graph indicates distances of the various positions in the arc tube from an origin that is an end of the arc tube. The solid line in the graph indicates the invention example, and the dotted line indicates the comparative example. Also, the chromaticity deviation is a deviation on the chromaticity diagram from a reference chromaticity at the various positions, where the reference chromaticity is a chromaticity value at the center of the lamp (position: 170 mm).

As indicated in FIG. 8, the largest chromaticity difference value in the x direction on the chromaticity diagram for the entire lamp is approximately 0.0058 for the invention example, and approximately 0.011 for the comparative example. Also, as indicated in FIG. 9, the largest chromaticity difference value in the y direction on the chromaticity diagram is approximately 0.0117 for the invention example, and approximately 0.0138 for the comparative example. That is to say, both in the x and y directions, the invention example is smaller than the comparative example in the largest chromaticity difference, and the invention example is smaller than the comparative example in the chromaticity difference over the entire arc tube. It was confirmed through experiments that by forming cracks in the surface of the protection layer that is in contact with the phosphor layer 34, the chromaticity difference in the arc tube is reduced compared with lamps with conventional constructions.

Up to now, Embodiment 1 of the present invention has been explained. However, the present invention is not limited to Embodiment 1, but may be modified as follows.

Figure 10:
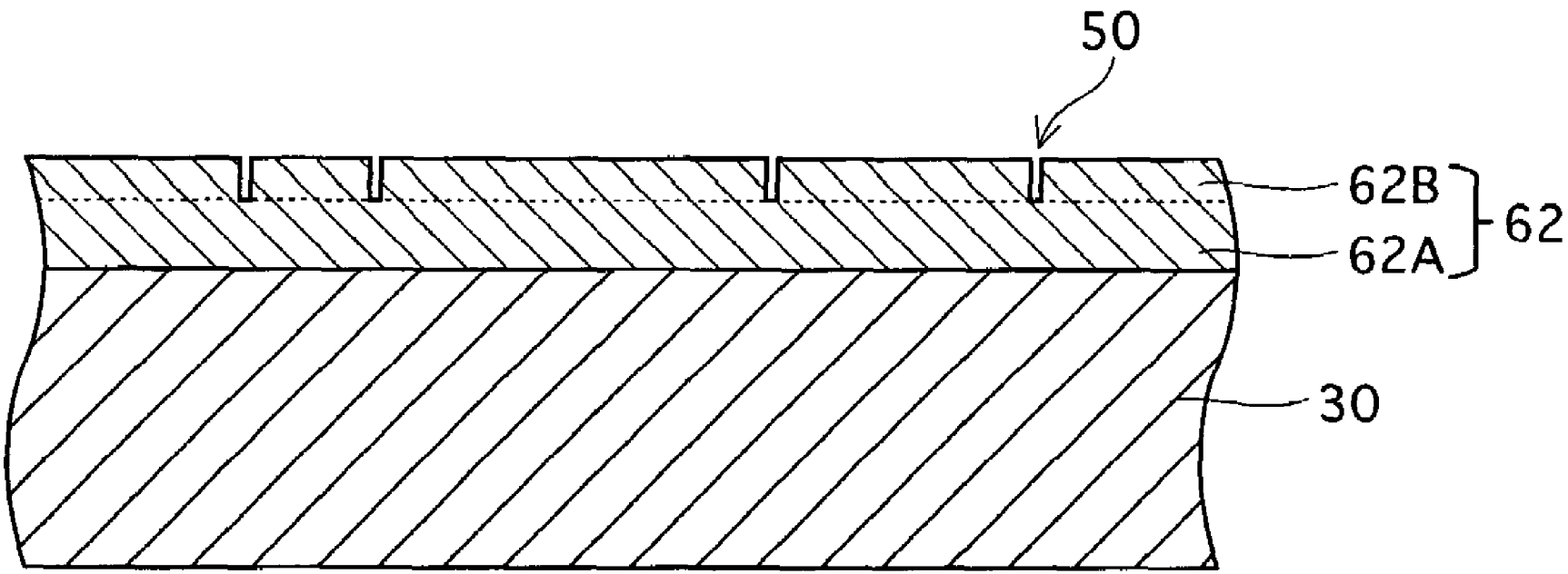
FIG. 10 is a cross section of the arc tube taken along a plane that includes the tube axis.

(1) In the above description, the protection layer is composed of one layer. However, the protection layer may be composed of a plurality of layers. FIG. 10 is a cross section of the arc tube taken along a plane that includes the tube axis. As shown in FIG. 10, a protection layer 62, which is a stack of a first protection layer 62A and a second protection layer 62B, is formed on the inner surface of the glass tube 30.

In the protection layer 62, cracks are hardly formed in the first protection layer 62A (for example, 10 cracks per mm in the tube axis direction are formed), and, for example, 200 cracks per mm are formed in the second protection layer 62B. With this construction, the cracks 50 formed in the second protection layer 62B make the phosphors distributed evenly, and mercury that entered the cracks 50 formed in the first protection layer 62A is prevented from reacting with the glass bulb. It is possible to restrict the mercury reaction effectively even if the cracks 50 are formed in the surface of the protection layer 62 that is in contact with the phosphor layer 34 because the phosphors are distributed evenly.

(2) In the above description, yttria is used as the metal oxide that forms the protection layer 32 or 62. However, titania ($TiO_2$), ceria ($CeO_2$), magnesia (MgO), lanthania ($La_2O_3$), or alumina ($Al_2O_3$) or any mixture of these may be used instead of yttria. Especially, titania and ceria have an effect of blocking the ultraviolet light, as well as the effect of restricting the mercury reaction. As a result, a lamp including a protection layer that includes titania or ceria as the metal oxide is suitable for a light source of a backlight apparatus that contains a lot of amount of plastic which is apt to be degraded by the ultraviolet light.

(3) In the above description, the cracks are formed in a shape of a turtle back. However, the cracks may be formed in another shape, such as in stripes.

(4) In the above-described embodiment, the arc tube is defined to be 340 mm in length, 4.0 mm in outer diameter, and 3.0 mm in inner diameter. However, the arc tube is not limited to this size. For example, the arc tube may be approximately 720 mm in length in the tube axis direction. Also, the arc tube is not limited to the shape of a straight tube, but may be in a shape of a curved tube.

(5) In the above description, a cold-cathode fluorescent lamp is described. However, the present invention is applicable to other types of lamps that include in their manufacturing process a process in which a phosphor suspension is applied to a glass tube while it is erected vertically, such as a ring-shaped fluorescent lamp that is widely used as a general lighting device.

Embodiment 2

Among fluorescent lamps, the cold-cathode fluorescent lamps are suitable for small-diameter lamps since they include a phosphor layer on the inner surface of a tube-shaped glass bulb and include, at both ends, cold cathodes as the internal electrodes. For this reason, cold-cathode fluorescent lamps are used as light sources for backlight units that are required to be thin (small in size).

Also, as a light source for a backlight unit, it is required to have a long life, that is to say, to have a high brightness maintenance factor. Degradation of the phosphors and consumption of mercury are one of the factors for an over-time decrease in brightness. Degradation of the phosphors and consumption of mercury are considered to occur as follows.

Conventionally, the phosphor layer includes a large number of phosphor particles and a linking agent that links the phosphor particles with each other. The linking agent used for the phosphor layer is, for example, a linking agent that consists of CBB (alkaline-earth metal borate). When such a linking agent is used, almost each particle of the CBB attaches to the phosphor particles as a spot to link the phosphor particles. For this reason, it is considered that the surfaces of the phosphor particles are exposed for the most part, not covered by the CBB.

The phosphor layer is bombarded by mercury ions that are generated when the cold-cathode fluorescent lamp is lighted. In the case of the above-described conventional phosphor layer, when the exposed surface portions of the phosphor particles are bombarded by mercury ions, their crystal structure transforms to become unable to emit light. Also, part of the mercury ions that bombard the phosphor particles or CBB remains in the phosphor particles or CBB. Therefore, the mercury that contributes to ultraviolet light emission is gradually consumed.

Japan Toku-Sai-Hyo (the official gazette containing a PCT patent application written in Japanese based on an international publication thereof) WO2002/047112 discloses a fluorescent lamp that includes a phosphor layer that uses, instead of the CBB, a yttrium oxide that has tolerance to bombardment by mercury ions. The official gazette states as follows: "the phosphor layer includes a plurality of phosphor particles and a metal oxide (yttrium oxide) that is disposed such that the metal oxide attaches to contact portions (linkage portions) of phosphor particles that are in contact with each other and such that surfaces of the plurality of phosphor particles are partially exposed" (the words in parentheses have been added by the Applicant of the present application). That is to say, in the phosphor layer of the official gazette, at least part of the surfaces of the phosphor particles, including the linkage portions, is covered with the yttrium oxide.

The phosphor layer as described in the official gazette is smaller in the exposed area of the surfaces of the phosphor particles than the above-described conventional phosphor layer. For this reason, the phosphor layer of the official gazette is less degraded by the bombardment by mercury ions and has less mercury consumption than the conventional phosphor layer, since mercury is consumed as much as it remains in the phosphor particles. Also, the phosphor layer of the official gazette, in which the linking agent is composed of a yttrium oxide, has less mercury consumption by the linking agent than the conventional phosphor layer. As a result, the phosphor layer of the official gazette has higher brightness maintenance factor than the conventional phosphor layer.

However, the phosphor layer of the official gazette has a problem that it is apt to be removed from the inner surface of the glass bulb easily. The phosphor layer may be removed by shocks that can be given during the manufacturing, packaging or shipment. The portion without the phosphor layer forms a shadow when the lamp is lighted, becoming the cause of the unevenness. Although the fluorescent lamps with the possibility of removal of the phosphor layer can be taken off through inspection before shipment, it brings reduction in the yield rate.

The adherence of the phosphor layer to the glass bulb can be enhanced by increasing the ratio of the yttrium oxide to the phosphor layer. However, the yttrium oxide has a property that it absorbs, although a slight amount of, ultraviolet light with a wavelength of 254 nm that excites phosphors. Accordingly, merely increasing the ratio of the yttrium oxide to the phosphor layer leads to the reduction in brightness.

It should be noted here that the above-described problem may happen even in an EEFL (External Electrode Fluorescent Lamp) that has an external electrode on the outer surface of the glass bulb.

It is an object of Embodiment 2 in consideration of the above-described problem to provide a fluorescent lamp that restricts the reduction in brightness and includes a phosphor layer that is difficult to remove.

The following describes Embodiment 2 of the present invention with reference to the attached drawings. It should be noted here that the lamp in Embodiment 2 differs from the lamp 20 in Embodiment 1 only in the construction of the phosphor layer. Accordingly, the following description centers on the phosphor layer of the present embodiment.

Figure 11A:
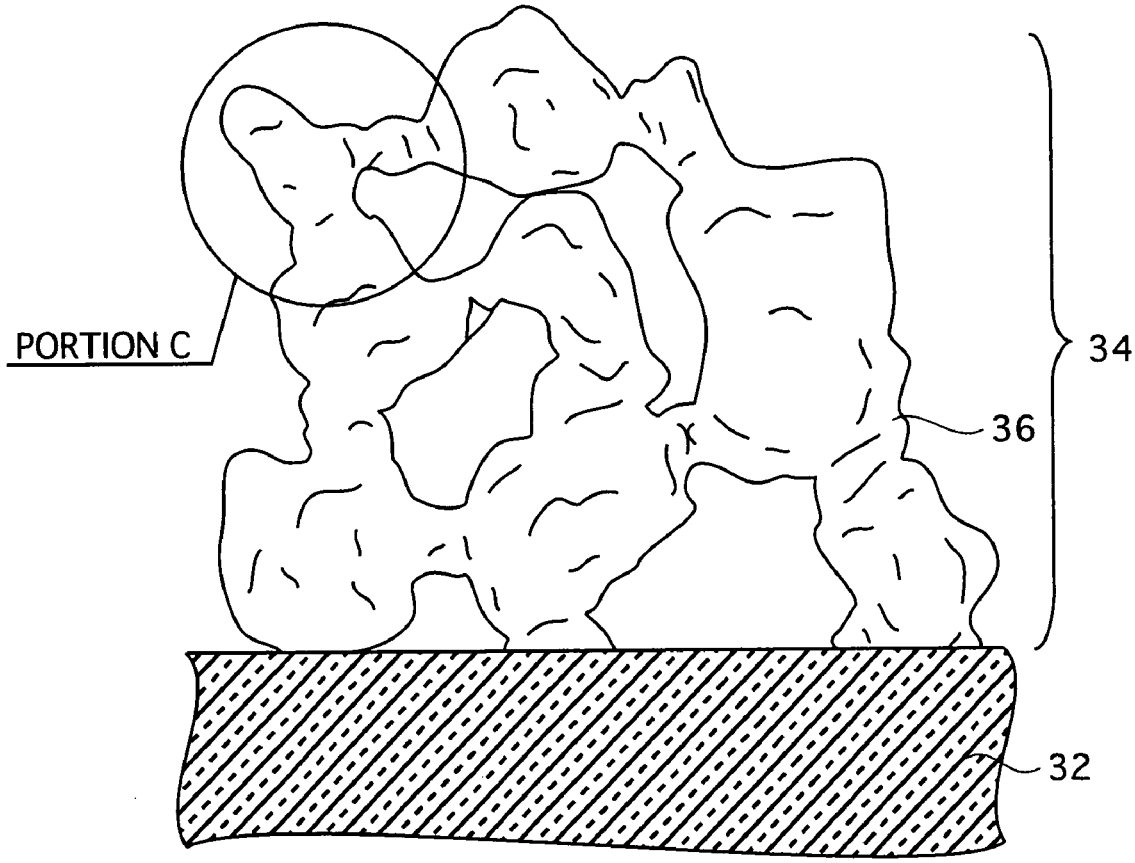
FIG. 11A is an enlarged view of the phosphor layer in the cold-cathode fluorescent lamp.
Figure 11B:
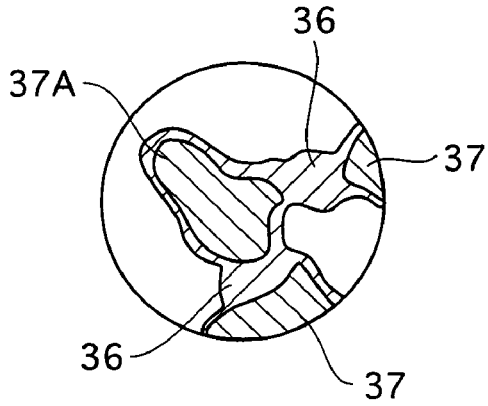
FIG. 11B is a cross sectional view of a portion C of the phosphor layer shown in FIG. 11A.

FIG. 11A is an enlarged view of the phosphor layer 34. FIG. 11B is a cross sectional view of a portion C of the phosphor layer 34 shown in FIG. 11A.

The phosphor layer 34 includes phosphor particles 37 and linking agent 36. The linking agent 36 is composed of an alkaline-earth metal borate (hereinafter referred to as CBB) and a yttrium oxide. Both of the two components constituting the linking agent 36 have functions of linking the phosphor particles 37 with each other and fixing the phosphor particles 37 to the protection layer 32.

In addition to these functions, the yttrium oxide has a function to protect the phosphor particles from the bombardment by mercury ions that are generated as mercury becomes ionized when the lamp is lighted. Also, in regards with two types of ultraviolet light respectively with wavelengths of 185 nm and 254 nm that are emitted from mercury, the yttrium oxide blocks (at least 70% of) the 185 nm-wavelength ultraviolet light and allows (approximately 85% of) the 254 nm-wavelength ultraviolet light to pass. Of these, the 185 nm-wavelength ultraviolet light degrades the phosphors and the 254 nm-wavelength ultraviolet light excites the phosphors to emit visible light.

On the other hand, CBB is added to enhance the linking force of the linking agent 36. It should be noted here that the 254 nm-wavelength ultraviolet light passes through CBB.

It is presumed that among a plurality of (large number of) phosphor particles 37 that exist in the phosphor layer 34 formed by a method that will be described later, there are some phosphor particles, like a phosphor particle 37A shown in FIG. 11B, whose whole surface is covered with the linking agent 36, and there are other phosphor particles, although not illustrated, whose surface is partially covered with the linking agent 36 and is partially exposed. That is to say, each phosphor particle is, partially or wholly, covered with the linking agent.

Figure 12:
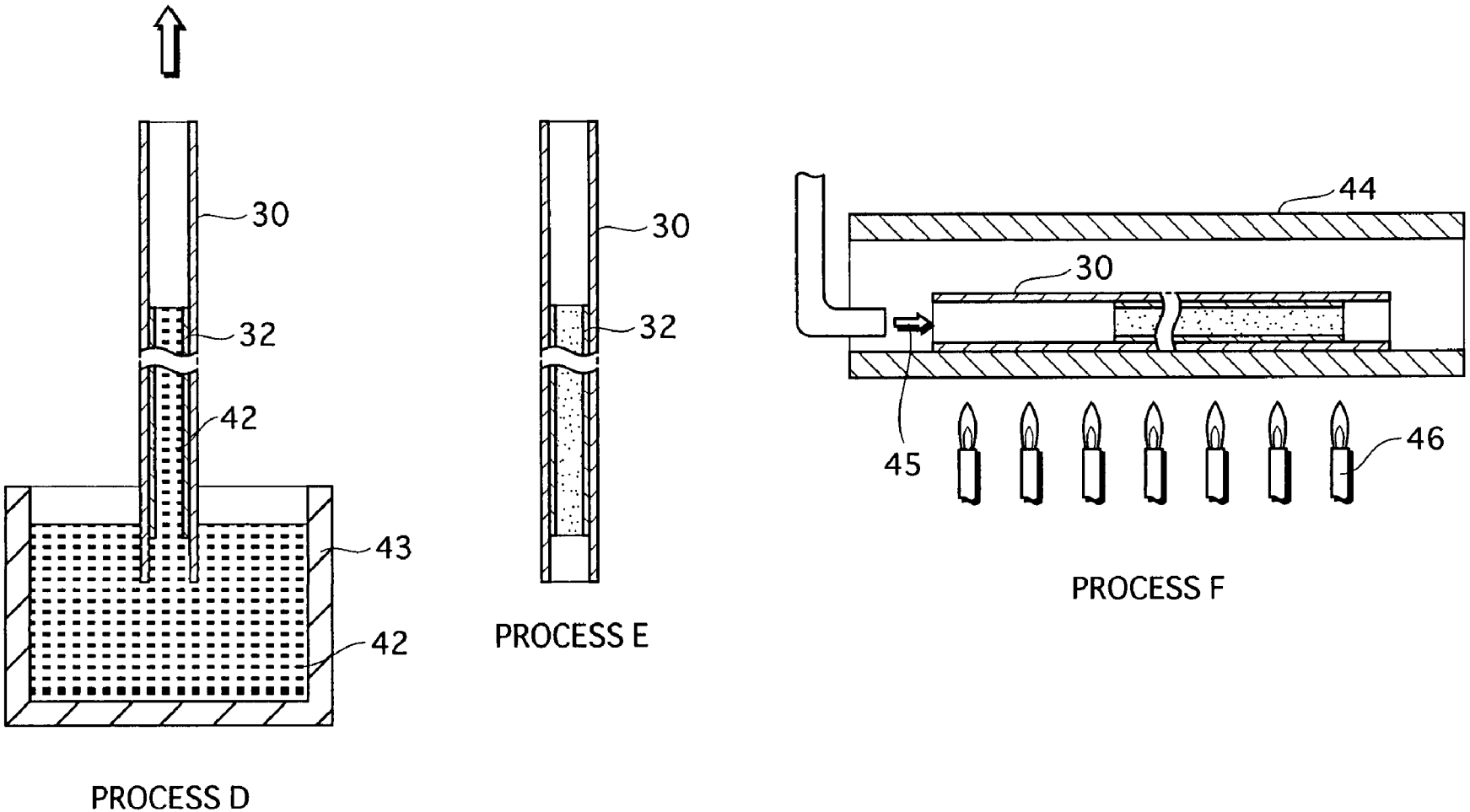
FIG. 12 shows part of procedures for forming the cold-cathode fluorescent lamp.

The following describes, among the manufacturing processes of the cold-cathode lamp having the above-described construction, a process of forming the phosphor layer, with reference to FIG. 12. The method of forming the phosphor layer is basically the same as a conventional one except for the composition of the suspension, which will be described below. Accordingly, the details of the method are omitted, and only the essential points will be described. It should be noted here that the protection layer 32 is formed by the method described in Embodiment 1.

First, in the process D shown in FIG. 12, a suspension containing phosphor particles is introduced into the glass tube 30 so that it is in contact with the protection layer 32 that has been formed on the inner surface of the glass tube 30.

More specifically, a tank 43 containing the phosphor suspension 42 is prepared. The phosphor suspension 42 is formed by adding, to butyl acetate as an organic solvent, a certain amount of phosphor particles, yttrium carboxylic acid $[Y(C_nH_{2n+1}COO)_3]$ as a yttrium compound, CBB particles, and nitrocellulose (NC) as a thickening agent.

The glass tube 30 is kept to be erected vertically with its lower end being soaked in the phosphor suspension 42. A vacuum pump (not illustrated) is used to evacuate inside of the glass tube 30 from an upper end thereof to pump the phosphor suspension 42 by creating a negative pressure inside the glass tube 30. The pumping is stopped before the liquid surface reaches the upper-most end of the glass tube 30 (when the liquid surface reaches a certain height), and the glass tube 30 is pulled up from the phosphor suspension 42. This allows the phosphor suspension 42 to attach to a certain area of the inner surface of the glass tube 30 and form a layer of the phosphor suspension 42.

The layer of the phosphor suspension 42 in the glass tube 30 is then dried as a dried warm air (25° C.-35° C.) is sent into the glass tube 30 (this process is not illustrated), and then a portion of the dried layer of the phosphor suspension 42 on the upper end of the glass tube 30 from which the phosphor suspension 42 was pumped up in the process D is removed (process E).

After this, in the process F, the glass tube 30 is laid horizontally inside a silica tube 44, and is sintered for five minutes as follows: the silica tube 44 is heated by a burner 46 from outside while dried air 45 is sent into the glass tube 30. The heating temperature of the burner 46 is adjusted such that the inner surface of the glass tube 30 is in the range from 650° C. to 750° C.

By this sintering, the yttrium carboxylic acid is thermally decomposed and glassy yttrium oxide ($Y_2O_3$) is formed.

Also, in the above-described sintering process, the CBB particles melt to form a glassy layer.

As described above, the phosphor layer 34 (FIG. 11) is formed.

Experiment 1

The inventors of the present invention manufactured an example of the above-described cold-cathode fluorescent lamp (referred to as invention example) in which the phosphor layer is composed of phosphor particles, yttrium oxide, and CBB, and also manufactured, for comparison, two types of comparative examples of cold-cathode fluorescent lamps that are different from the invention example only in the structure of the phosphor layer.

One of the two types of comparative examples is a cold-cathode fluorescent lamp (comparative example 1) in which the phosphor layer is composed of phosphor particles and CBB, and the other is a cold-cathode fluorescent lamp (comparative example 2) in which the phosphor layer is composed of phosphor particles and yttrium oxide.

Also, when the total weight of the phosphor particles is presumed to be 100, the ratio of yttrium oxide and CBB to the total weight is as follows:

Invention example . . . yttrium oxide: 0.4, CBB: 0.2 comparative example 1 . . . CBB: 1.0 comparative example 2 . . . yttrium oxide: 0.6

The three types of lamps were lighted for 2,000 hours in total, and the change in brightness over time was observed.

Figure 13:
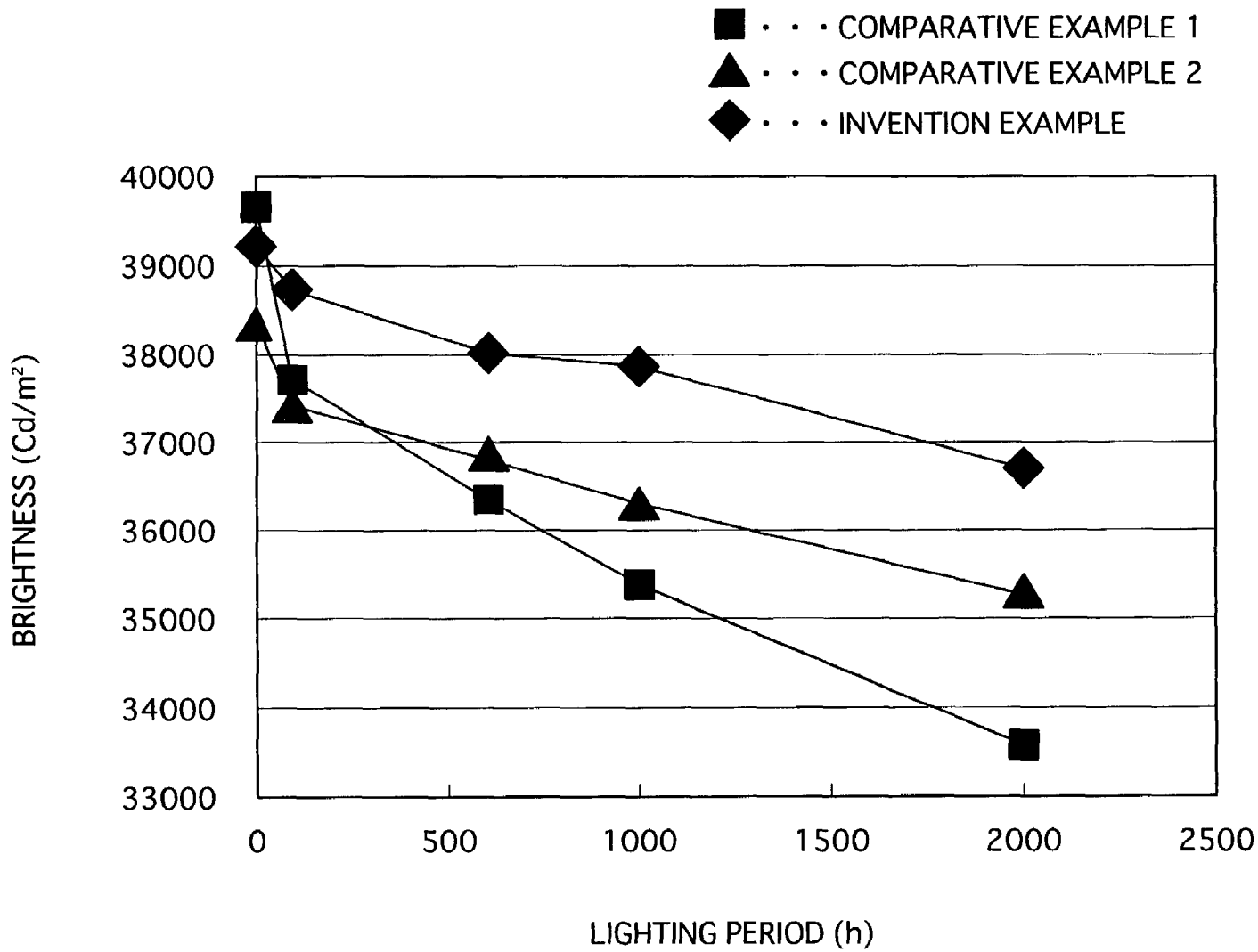
FIG. 13 shows the change in brightness over time in cold-cathode fluorescent lamps of comparative examples 1 and 2 and the invention example.

The experimental results are shown in FIG. 13.

In terms of the brightness of the lamp immediately after the start of the experiment (hereinafter referred to as "initial brightness"), the comparative example 1 is the highest, followed by the invention example, and the comparative example 2. The reason for this is considered as follows. The CBB passes more amount of ultraviolet light with a wavelength of 254 nm, which contributes to emission of light by the phosphors, than the yttrium oxide does. Also, the phosphor particles in the lamp of the comparative example 1 is larger than the other two types of lamps in the area of the surface that is exposed, not covered with the linking agent. Accordingly, the phosphor particles in the lamp of the comparative example 1 receive more amount of ultraviolet light than those of the other two types of lamps. The comparative example 1 therefore has the highest value of the initial brightness.

It is observed that there is a difference in the initial brightness (also in the brightness thereafter) between the invention example and the comparative example 2. The reason for this is considered as follows. As will be described later, the linking agent that is composed of only yttrium oxide (comparative example 2) is weaker in the linking force than the linking agent that is composed of yttrium oxide and CBB (invention example). Accordingly, in the case of the comparative example 2, even if the phosphor layer is not removed, the ratio of the phosphor particles fixed in the phosphor layer is low, and the phosphor particles depart from the phosphor layer to a certain extent. This creates the difference in the brightness between them.

It is found that the comparative example 1 rapidly decreases in brightness from the start of the experiment. This is because since the phosphor particles of the comparative example 1 have more exposed area, they apt to be degraded by the bombardment by mercury ions, and mercury is easily adsorbed by the phosphor particles. Also, CBB is easy to adsorb mercury. Accordingly, it is considered that the rapid decrease in brightness occurs as the degradation of phosphor particles and the consumption of mercury rapidly proceed in the initial stage.

Figure 14:
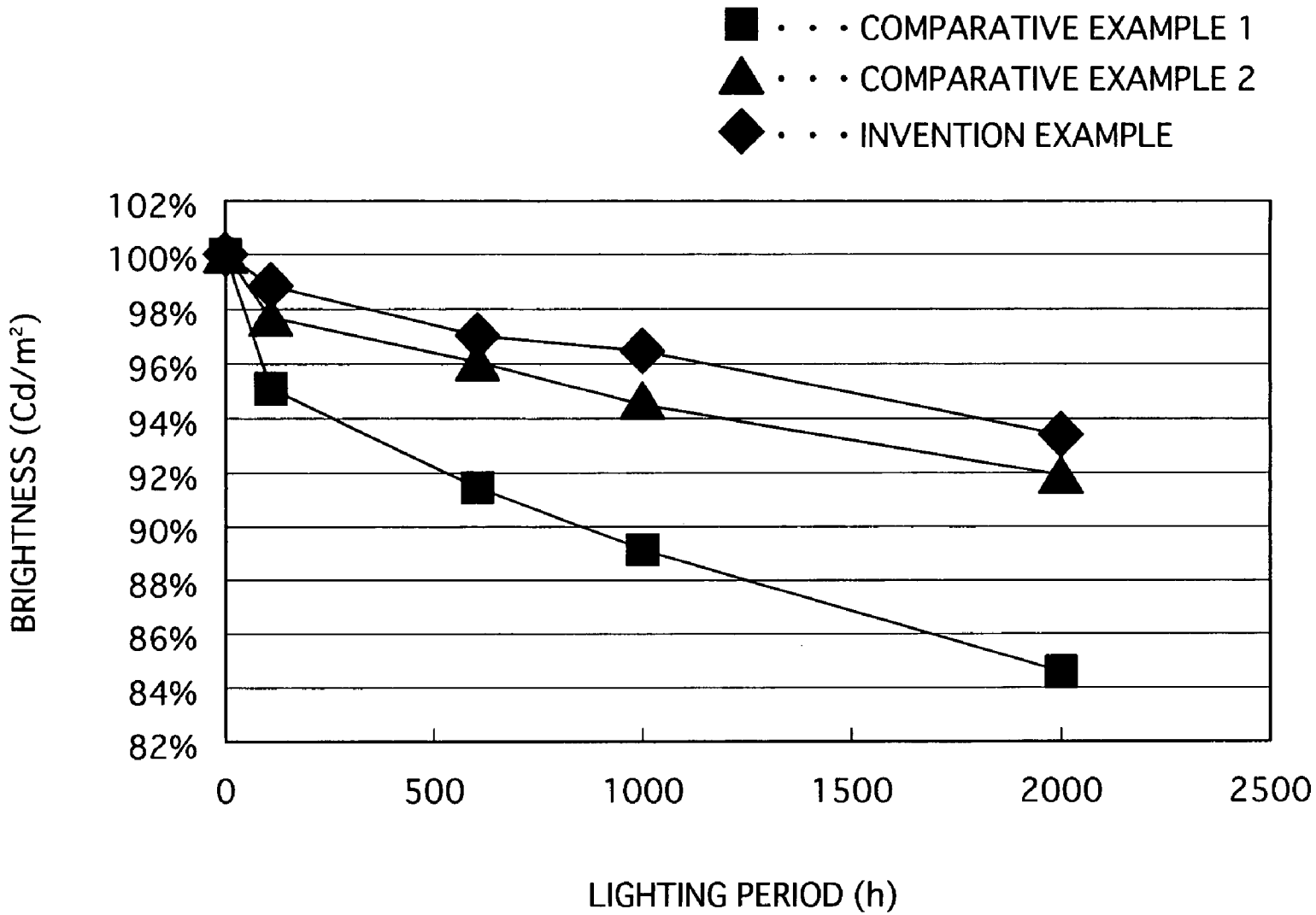
FIG. 14 is a graph that was generated based on the graph of FIG. 13 and shows the change in brightness maintenance factor over time when the initial brightness is 100%.

FIG. 14 is a graph that was generated based on the graph of FIG. 13 and shows the change in brightness maintenance factor over time when the initial brightness is presumed to be 100%.

It is found from FIG. 14 that the reduction ratio of the brightness maintenance factor at approximately 100 hours later the start of the experiment and after, both proceed in parallel. As this indicates, the invention example and the comparative example 1 have substantially identical values. It is also found that the comparative example 1 has a higher reduction ratio of the brightness maintenance factor than the invention example and the comparative example 2.

The results of the Experiment 1 are summarized as follows.

The invention example is superior than the comparative example 1 in the brightness maintenance factor. That is to say, the invention example has a longer life than the comparative example 1. The invention example is equal to or superior than the comparative example 2 in the brightness maintenance factor.

Experiment 2

The inventors of the present invention performed a shock test with the samples that have different mixture ratios of yttrium oxide and CBB in the phosphor layer, to check whether or not the phosphor layer is removed by shocks.

More specifically, when the total weight of the phosphor particles is presumed to be 100, the ratio of yttrium oxide to the total weight was varied in the range from 0 to 0.6, and the ratio of CBB to the total weight was varied in the range from 0 to 0.7, respectively at the interval of 0.1. And 20 samples were manufactured for each of a plurality of types of sample lamps that have different combinations of the ratios, and the shock text was conducted with the samples.

The reason why the upper limit of the ratio of yttrium oxide to the total weight was set to 0.6 is as follows. As described earlier, the lamp brightness decreases as the ratio of yttrium oxide increases. It is necessary to restrict the lamp brightness reduction to a certain level compared with conventional lamps that use only CBB as the linking agent. In this case, it is possible to restrict the lamp brightness reduction to 3% or less because the upper limit of the ratio of yttrium oxide to the total weight is 0.6. It should be noted here that less than 3% of lamp brightness reduction causes no problem in practical use.

Figure 15:
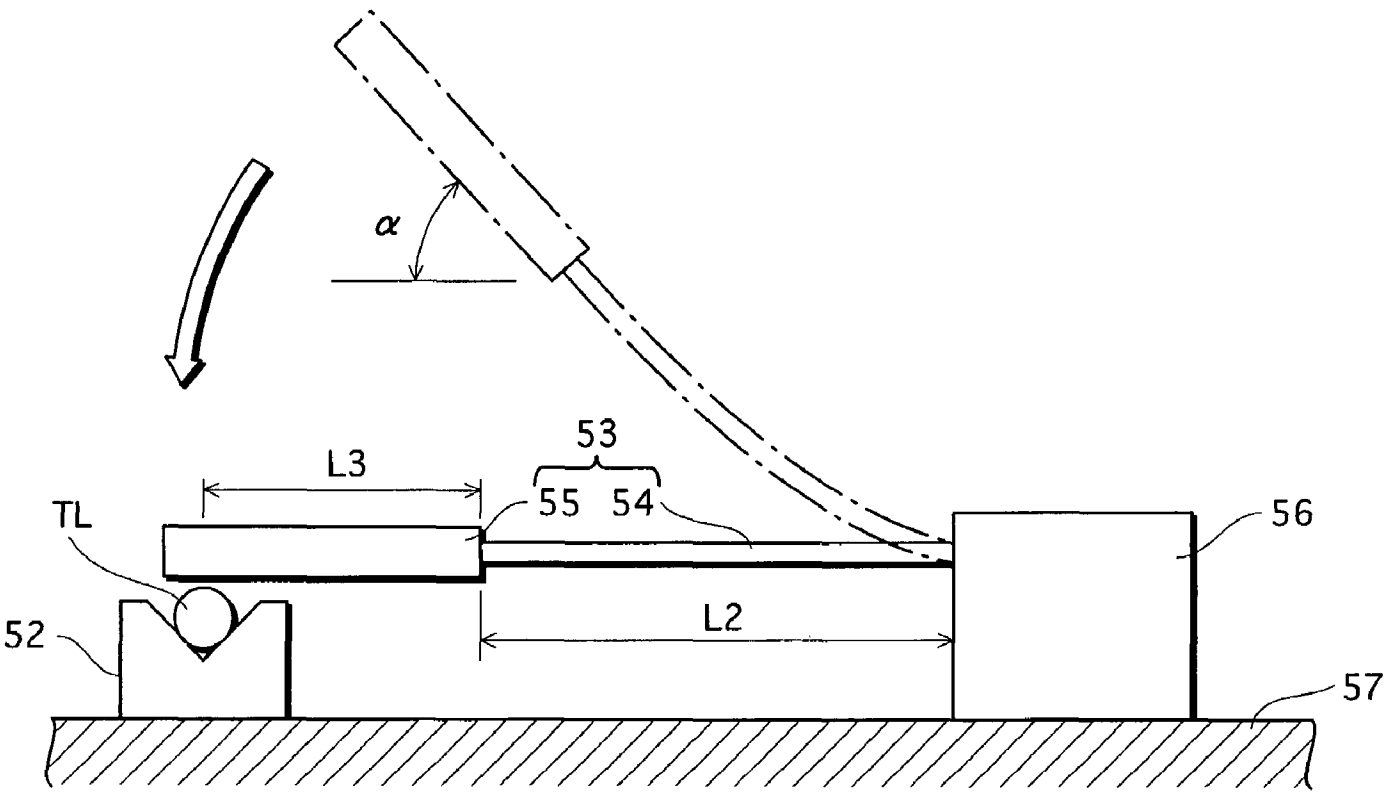
FIG. 15 shows a test apparatus used in the shock test for checking the removal of the phosphor layer.

FIG. 15 shows a test apparatus 51 used in the shock test.

The test apparatus 51 includes a lamp support platform 52 and a test rod fixed platform 56. Both the lamp support platform 52 and the test rod fixed platform 56 are fixed on a base 57.

The lamp support platform 52 is in a shape of a "V block" that extends in a direction perpendicular to the plane of the paper of FIG. 15. The glass bulb for a test lamp TL is laid on the lamp support platform 52 to fit in the V-shaped groove formed therein.

One end of a test rod 53 is fixed in the test rod fixed platform 56. A point where the test rod 53 is fixed in the test rod fixed platform 56 becomes a supporting point for the fixing. The test rod 53 includes a coil spring 54 and a plastic rod 55. A length L2 between the supporting point for the fixing and the connecting point at which the coil spring 54 and the plastic rod 55 are connected with each other is 30 mm. The plastic rod 55 is in a shape of a cylinder with 8 mm of a diameter. A length L3 between the connecting point and the center of the V-shaped groove is 20 mm. The plastic rod 55 is made of Teflon (Trademark Registered).

The test procedures using the test apparatus 51 with the above-described construction are as follows.

(i) The test lamp TL is placed on the lamp support platform 52.

(ii) The plastic rod 55 is lifted up to bend the coil spring 54 until an angle $\alpha$ between the axis center of the plastic rod 55 and the horizontal direction is 45 degrees. At this time, a load of 0.1 kgf is added to a portion of the plastic rod 55 that is to hit the glass bulb in the direction perpendicular to the axis center of the plastic rod 55.

(iii) The plastic rod 55 is released to give a shock to the test lamp TL with the plastic rod 55 by the force of the restoring 54.

(iv) It is checked with eyes whether or not any portion of the phosphor layer of the test lamp TL has been removed.

The above processes (i) to (iv) were repeated 20 times for each test lamp. Some types of test lamps for which one or more out of the lamp 20 test lamps had a removal of the phosphor layer were rejected, and other types of test lamps for which none of the lamp 20 test lamps had a removal of the phosphor layer passed.

FIG. 16 shows the results of the experiment.

In FIG. 16, the row "A" indicates mixture ratios of the yttrium oxide, and the column "B" indicates mixture ratios of the CBB.

In FIG. 16, test lamps that correspond to the element with character "NG1" are rejected test lamps. The other test lamps (not performed at A=0 and B=0) passed the shock test. As understood from the experiment results, it was confirmed that when B=0, that is to say, when the linking agent is made of only the yttrium oxide, the phosphor layer is removed. Also, it was confirmed that even when A=0, that is to say, when the linking agent is made of only the CBB, the phosphor layer is removed if a small amount of CBB is added.

It is understood from the results shown in FIG. 16, that from the viewpoint of preventing the phosphor layer from being removed, it is necessary that "$0.1 \leqq A$" or "$0.1 \leqq B$", and "$0.4 \leqq (A+B)$".

As described above, it is understood that from the viewpoint of preventing the phosphor layer from being removed, it is preferable that the linking agent is made of a mixture of the yttrium oxide and CBB, and that the total amount of both materials is increased. However, the inventors of the present invention found that if the total amount of both materials exceeds a certain level, when observed from outside, the color of the glass bulb changes to pale brown, which decreases the brightness. It is considered that the following is the reason for this. That is to say, in the sinter process in the manufacturing procedure, when the yttrium carboxylic acid is thermally decomposed, a carbon hydride that is represented by a general formula $C_nH_{2n+2}$ is generated, as well as the yttrium oxide. On the other hand, CBB melts and becomes glassy. It is considered that the CBB takes in the carbon hydride and changes to the color of brown.

In FIG. 16, test lamps that correspond to the element with character "NG2" are those test lamps that were rejected because the glass bulb changed the color of pale brown, decreasing the brightness to such a level that is under a qualifying standard. Here, the qualifying standard is the same as that when the upper limit of the ratio of yttrium oxide to the total weight of the phosphor particles is defined (set). That is to say, lamps with the brightness decreasing by more than 3% of the conventional lamp that uses only CBB in the linking agent were rejected (NG2)

From FIG. 16, it is understood that from the viewpoint of preventing the brightness from decreasing, it is necessary that "A≦0.6" or "B≦0.6", and "(A+B)≦0.7".

As described above, it is understood that from both viewpoints of preventing the phosphor layer from being removed and preventing the brightness from decreasing, it is necessary that for the linking agent, the yttrium oxide and CBB are mixed such that "0.1≦A≦0.6" (or "0.1≦B≦0.6") and "0.4≦(A+B)≦0.7" (in FIG. 16, test lamps that correspond to the element with "OK").

Up to now, the present invention has been described based on the embodiments thereof. However, not limited to the embodiments, the present invention may take other forms such as the following.

(1) In the above-described embodiments, a CCFL (Cold-Cathode Fluorescent Lamp) was used as an invention example. However, not limited to this, the present invention is applicable to what is called an EEFL (External Electrode Fluorescent Lamp) that is a dielectric barrier discharge fluorescent lamp that uses the glass bulb wall as a capacitance by, for example, having external electrodes on the outer surface of the glass bulb at both ends thereof, instead of the internal electrodes.

(2) CBBP, which is made by adding P (calcium pyrophosphate) to the CBB, may be used instead of the CBB as the alkaline-earth metal borate. In this case, it is preferable that CBB and P are mixed with a given ratio such that 0.7 or less of P is added to CBB that is presumed to be 1. This is because if the ratio of P exceeds 0.7, adsorption of mercury is apt to occur, increasing the decrease of the lamp brightness. In other words, when CBB that does not contain P is used as the alkaline-earth metal borate, the reduction in brightness due to the adsorption of mercury is restricted, compared with the case where the CBBP is used.

Embodiment 3

The fluorescent lamps emit light as mercury, which is contained in an arc tube, radiates ultraviolet light upon obtainment of energy from electrons, and the ultraviolet light excites the phosphors to emit visible light.

Meanwhile, it is known that the mercury in the arc tube attaches to the phosphor particles that constitute the phosphor layer to decrease the amount of ultraviolet light that is incident to the phosphor particles, decreasing the luminous flux maintenance factor. In regards with this problem, technologies for coating the phosphor particles with a metal oxide have been disclosed as a technology for preventing the amount of ultraviolet light, which is incident to the phosphor particles, from decreasing (for example, Japanese Patent Publication No. 2653576, Japanese Laid-Open Patent Application No. 07-316551, and Japanese Laid-Open Patent Application No. 05-320636). For example, it is possible to restrict mercury from attaching to the phosphor particles and thus restricting the reduction of the luminous flux maintenance factor of the fluorescent lamp, by coating the surfaces of the phosphor particles with a layer of a metal oxide by the known sol-gel process.

However, the inventors of the present invention performed a characteristic test on the various fluorescent lamps to which the technologies disclosed in the above-mentioned official gazettes had been applied, and found that in regards with cold-cathode fluorescent lamps, although some improvement was observed, an enough level of luminous flux maintenance factor could not be obtained.

It is an object of Embodiment 3 in consideration of the above-described problem to provide a cold-cathode fluorescent lamp and a backlight apparatus that have high luminous flux maintenance factor.

The following describes the cold-cathode fluorescent lamp in Embodiment 3 with reference to the attached drawings. It should be noted here that the lamp in Embodiment 3 differs from the lamp 20 in Embodiment 1 only in the construction of the phosphor particles in the phosphor layer. Accordingly, the following description centers on the phosphor particles in the phosphor layer.

Figure 17:
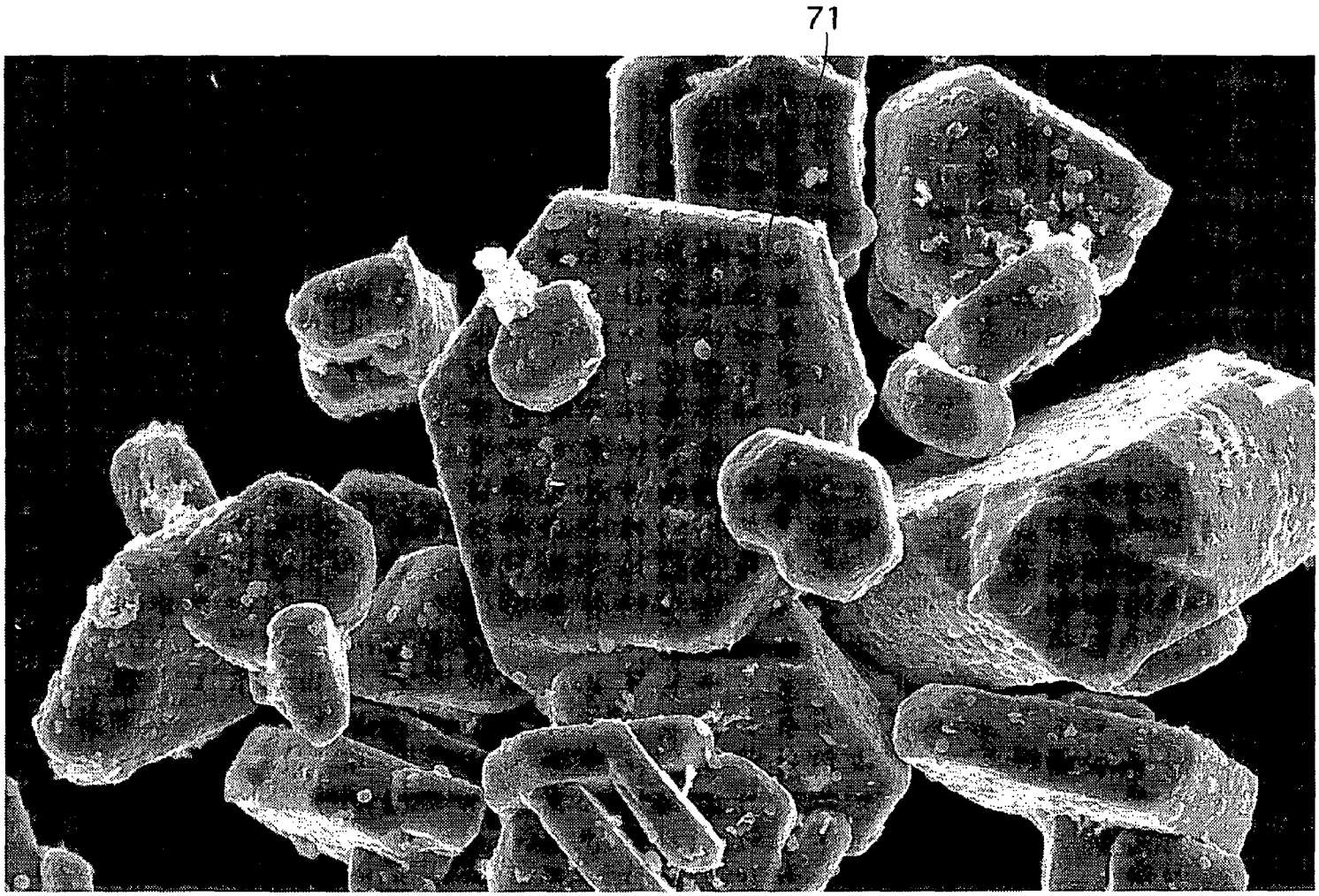
FIG. 17 is an enlarged photo of phosphor particles 71 in Embodiment 3 that was photographed by a scanning electron microscope (SEM)
Figure 18:
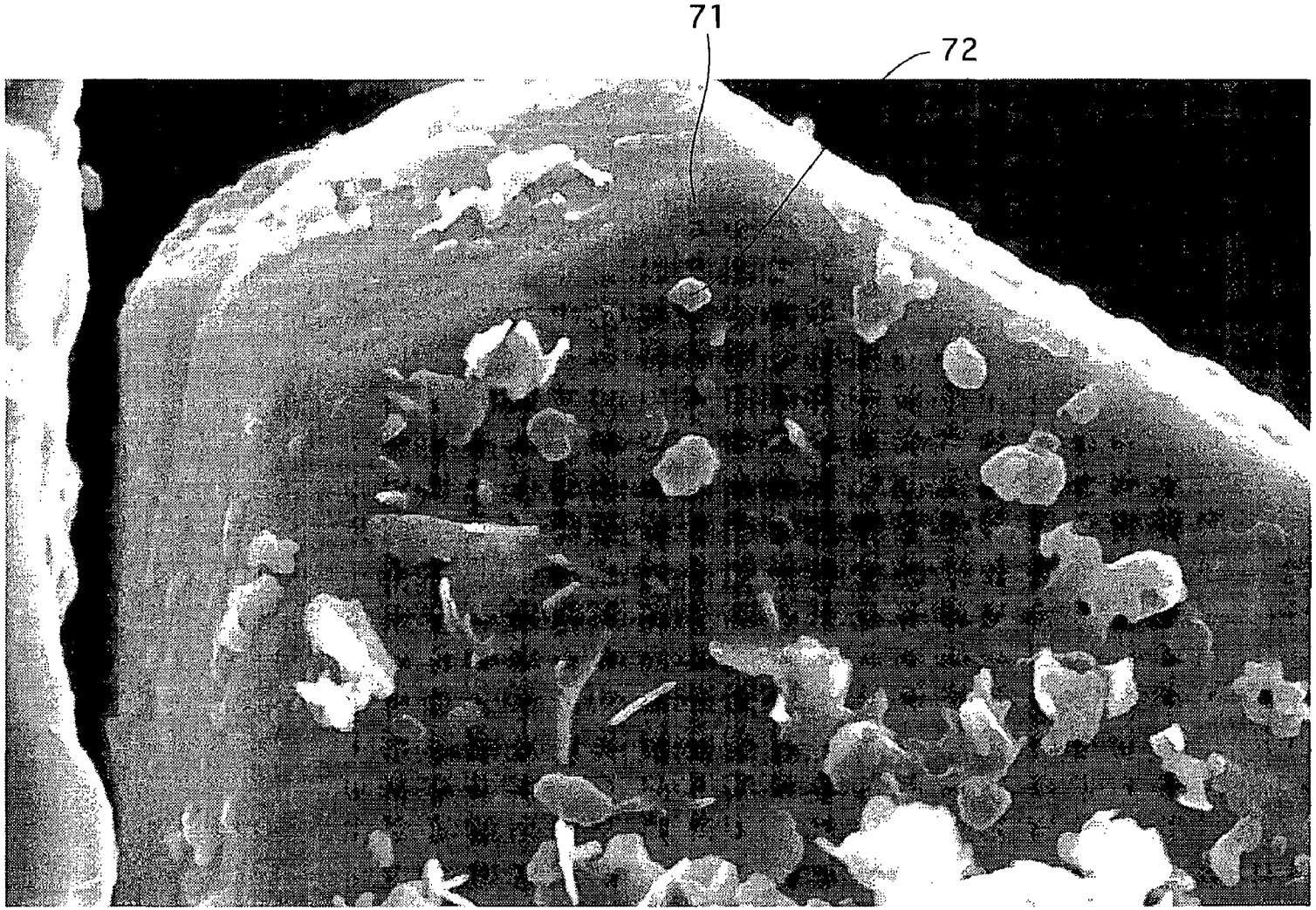
FIG. 18 is an enlarged photo of the phosphor particles 71 that was photographed with a magnification factor that is higher than that with FIG. 17.

FIG. 17 is an enlarged photo of phosphor particles 71 in Embodiment 3 that was photographed by a scanning electron microscope (SEM). FIG. 18 is an enlarged photo of the phosphor particles 71 that was photographed with a magnification factor that is higher than that with FIG. 17.

As shown in FIG. 18, particles 72 of magnesium oxide (MgO) are sparsely distributed and attached to the surfaces of the phosphor particles 71. It was confirmed through experiments, which will be described later, that this restricts the reduction of the luminous flux maintenance factor.

When, as in conventional technologies, phosphor particles whose surfaces are not coated with a metal oxide are used, mercury attaches to the phosphor particles while the lamps are lighted, and the amount of ultraviolet light that is incident to the phosphor particles is reduced, which gradually reduce the luminous flux maintenance factor.

Also, it is considered that when, as in conventional technologies, the surfaces of the phosphor particles are completely covered with a metal oxide, mercury becomes difficult to attach to the phosphor particles, thus improving the luminous flux maintenance factor, but the metal oxide itself is transformed due to an unknown cause during the lamp lighting, which gradually makes it difficult for ultraviolet light to reach the phosphor particles, thus reducing the luminous flux maintenance factor.

In the lamp 20 in the present embodiment, the magnesium oxide particles 72 are sparsely distributed and attached to the surfaces of the phosphor particles 71. It is considered that this construction improves the luminous flux maintenance factor for the following two reasons.

The first reason is that the phosphor particles 71 with the magnesium oxide particles 72 on their surfaces restrict mercury from attaching to the phosphor particles more than phosphor particles with no metal oxide on their surfaces.

The second reason is that the phosphor particles 71 with the magnesium oxide particles 72 on their surfaces make it difficult for the reduction of the luminous flux maintenance factor to occur, which is attributable to the transformation of the metal oxide, than phosphor particles whose surfaces are completely covered with the metal oxide.

It is considered that the lamp 20 in the present embodiment can improve the luminous flux maintenance factor more than lamps to which conventional technologies are applied, with the above-described two factors combined.

It is further preferable that the magnesium oxide particles 72 are evenly distributed over the entire surfaces of the phosphor particles 71. When the magnesium oxide particles 72 are unevenly distributed onto the surfaces of the phosphor particles 71, mercury is apt to attach to areas on which there is hardly magnesium oxide particles, which reduces the luminous flux maintenance factor. In contrast, by distributing the magnesium oxide particles evenly over the entire surfaces of the phosphor particles 71, mercury is made to be difficult to attach to the surfaces of the phosphor particles as a whole, and accordingly it restricts the reduction of the luminous flux maintenance factor.

It should be noted here that in FIGS. 17 and 18, the coverage ratio of the magnesium oxide particles 72 covering the phosphor particles 71 is approximately 40%. The coverage ratio is obtained by measuring the ratio of the magnesium oxide particles 72 to the phosphor particles 71 in area.

The particle diameter of the phosphor particles 71 is approximately in the range from 5 μm to 10 μm. It is preferable that the average particle diameter of the magnesium oxide particles 72 is in the range from 0.01 μm to 0.1 μm. This is because the amount of ultraviolet light that reaches the phosphor particles is reduced, thus reducing the luminous flux, and because it is difficult to manufacture magnesium oxide particles that have a particle diameter of less than 0.01 μm.

The following describes the method of manufacturing the phosphor particles 71 in the present embodiment with reference to FIGS. 19A to 19D. FIGS. 19A to 19D show the method of attaching the magnesium oxide particles to the surfaces of the phosphor particles.

Figure 19A:
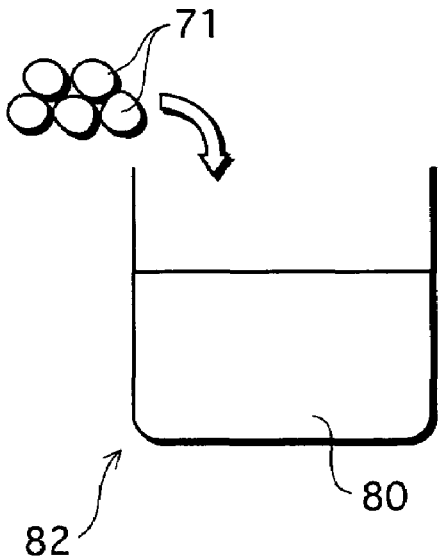
FIGS. 19A to 19D show the method of attaching the magnesium oxide particles to the surfaces of the phosphor particles 71.

First, as shown in FIG. 19A, phosphor particles 71 are put into a beaker 82 that contains distilled water 80, and the distilled water 80 with the phosphor particles 71 is stirred such that the phosphor particles 71 are distributed evenly. The solvent used here may be a mixture of distilled water and alcohol.

Figure 19B:
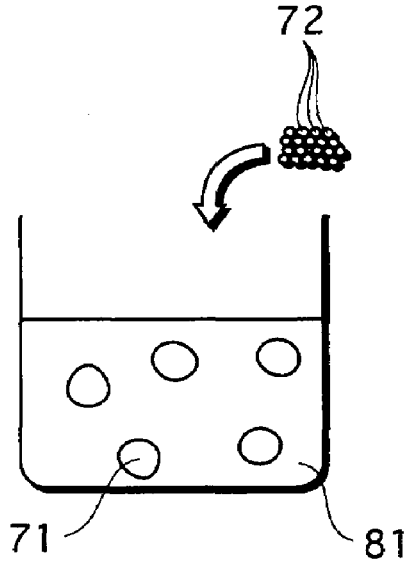
Figure 19C:
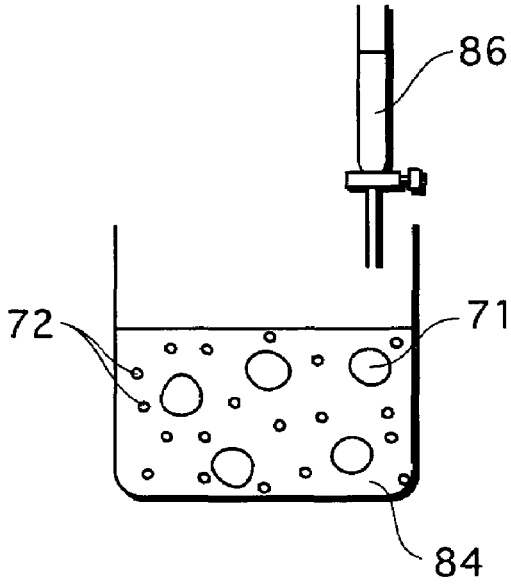

Next, as shown in FIG. 19B, the magnesium oxide particles 72 are put into an aqueous solution 81, which is a result of the above process. This aqueous solution 81 with the magnesium oxide particles 72 is stirred such that, as shown in FIG. 19C, the magnesium oxide particles 72 as well as the phosphor particles 71 are distributed in an aqueous solution 84.

Figure 19D:
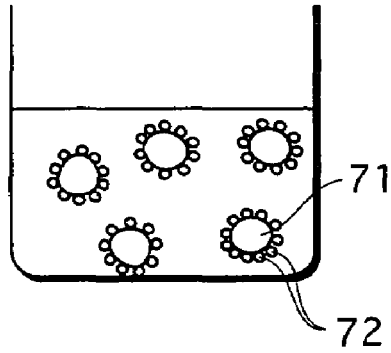

Then, drops of an acid or an alkali solution 86 are put into the aqueous solution 84 to adjust the pH of the aqueous solution 84. Here, the pH of the aqueous solution 84 is adjusted to be near an intermediate value of isoelectric points of the phosphor particles 71 and the magnesium oxide particles 72. The stirring is continued for a predetermined time period, so that as shown in FIG. 19D, the magnesium oxide particles 72 disperse and attach to the surface of each phosphor particle 71 by an electrostatic force of attraction. At this time, the magnesium oxide particles 72 are distributed approximately evenly over the entire surfaces of the phosphor particles 71.

It should be noted here that the reason why the pH of the aqueous solution 84 is adjusted to be near an intermediate value of isoelectric points of the phosphor particles 71 and the magnesium oxide particles 72 is as follows. If, for example, a reaction is made with a pH near an intermediate value of isoelectric points of the phosphor particles 71, the surface potential of the phosphor particles 71 becomes very small, which makes the adsorption between the phosphor particles 71 and the magnesium oxide particles 72 difficult. On the other hand, if a reaction is made with a pH near an intermediate value of isoelectric points of the magnesium oxide, the magnesium oxide particles 72 clump together, which makes it difficult for the magnesium oxide particles 72 to attach to the phosphor particles 71.

When the pH of the aqueous solution 84 is adjusted to be near an intermediate value of isoelectric points of the phosphor particles 71 and the magnesium oxide particles 72, the magnesium oxide particles 72 disperse and attach to the surface of each phosphor particle 71 by an electrostatic force of attraction, as shown in FIGS. 17 and 18.

It should be noted here that the ratio of the magnesium oxide particles 72 covering the phosphor particles 71 can be adjusted by adjusting the pH of the aqueous solution, the density of the magnesium oxide particles 72 in the aqueous solution, the reaction time and the like.

After this, the phosphor particles 71 are separated from the solvent by the suction filtration. The phosphor particles 71 are then cleaned by alcohol, the alcohol is dried off at a normal temperature, and then the phosphor particles 71 are dried at a high temperature for a predetermined time period.

Following this, phosphors obtained by this are put into a solvent that contains a linking agent and a binder, and the solvent is stirred to be a phosphor suspension. The phosphor suspension is applied onto the protection layer 32 formed on the inner surface of the glass tube 30, dried and sintered. This forms the phosphor layer 34 that covers and attaches to the protection layer 32 formed on the inner surface of the glass tube 30.

The inventors of the present invention performed a characteristic test on the lamp of the present embodiment and a conventional lamp. More specifically, prepared are an invention example for the lamp 20 that is 40% in the coverage ratio, a comparative example 1 that is manufactured by the sol-gel process and is 100% in the coverage ratio (Patent Document 1), and a comparative example 2 that is not processed specifically (0% in the coverage ratio), and the luminous flux maintenance factor was measured.

Figure 20:
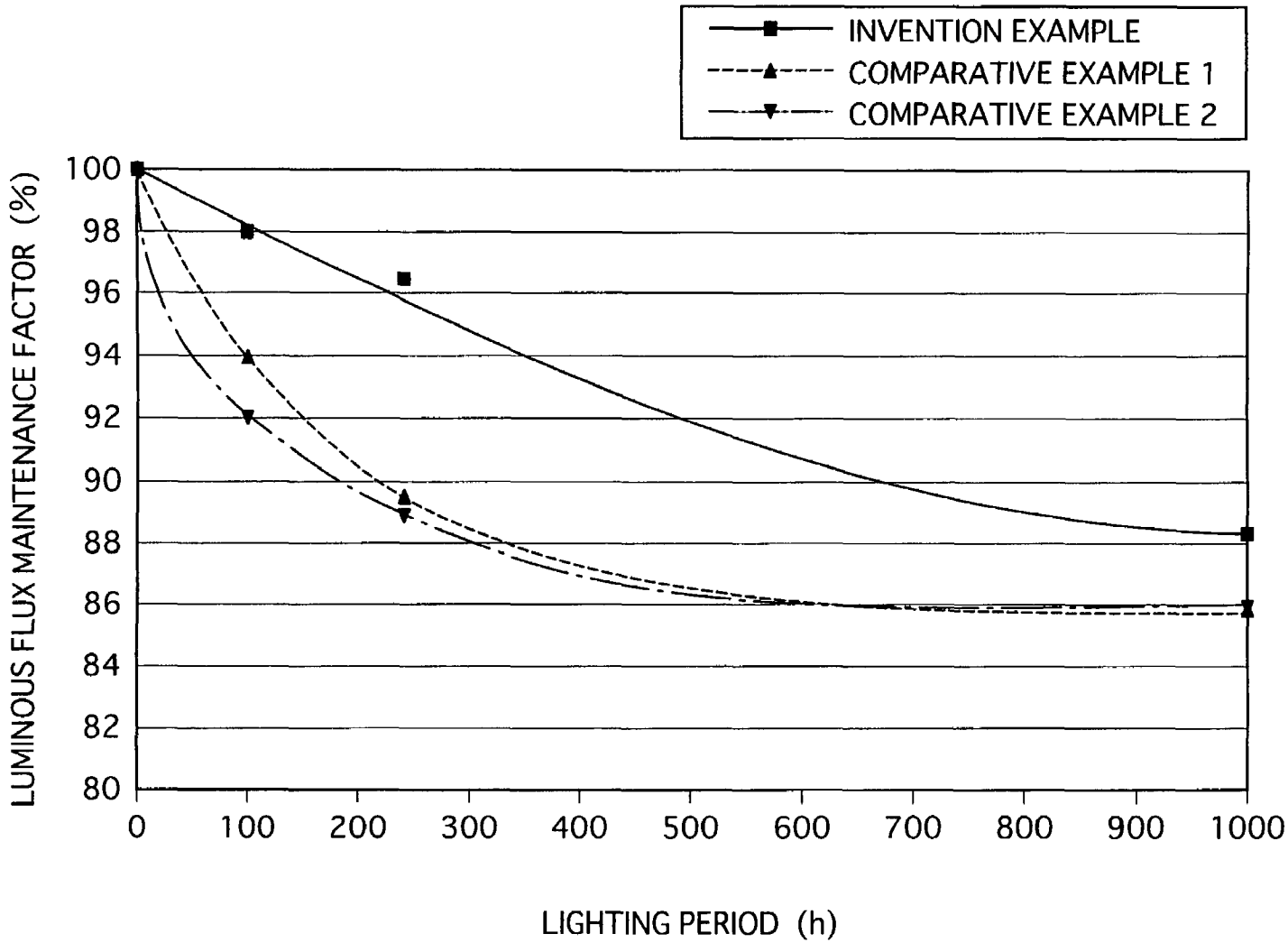
FIG. 20 is a graph that shows the results of the characteristic test performed on the invention example, and the comparative examples 1 and 2, and is a plot of the luminous flux maintenance factor and the life time.

FIG. 20 is a graph that shows the results of the characteristic test performed on the invention example, and the comparative examples 1 and 2, and is a plot of the luminous flux maintenance factor and the life time. The vertical axis of the graph indicates the luminous flux maintenance factor (%) and the horizontal axis indicates the life time (h). In FIG. 20, the solid line represents the invention example, the dotted line represents the comparative example 1, and the dashed line represents the comparative example 2.

As understood from the graph, the comparative example 1, which is 100% in the coverage ratio with use of the sol-gel process, shows slight improvement compared with the comparative example 2 which has not been processed specifically, but it cannot be said that the comparative example 1 has enough luminous flux maintenance factor.

On the other hand, the invention example shows great improvement in luminous flux maintenance factor. The comparative examples 1 and 2 decrease rapidly in luminous flux maintenance factor after the lighting starts, but the invention example decreases gradually in luminous flux maintenance factor compared with the comparative examples 1 and 2. This is considered as an advantageous effect.

In regards with the brightness immediately after the lighting is started (when the lighting is started, the life time is 0 hours), the following results were obtained. The comparative example 1, which is 100% in the coverage ratio with use of the sol-gel process, was approximately 4200 cd/m$^2$ and the comparative example 2 which has not been processed specifically was approximately 4400 cd/m$^2$ in the brightness immediately after the start of the lighting. It is considered that this is because the comparative example 1 in which the phosphor particles were covered 100% with the metal oxide by the sol-gel process became more difficult to be excited by the ultraviolet light than the comparative example 2 which has not been processed specifically.

In contrast, the invention example 1 was approximately 4520 cd/m$^2$ in the brightness immediately after the start of the lighting, which is far larger than that of the comparative example 2. It is considered that this is because due to the presence of the particles 72 of magnesium oxide on the surfaces of the phosphor particles 71, the amount of reflection of the ultraviolet light at the surfaces of the phosphor particles 71 decreased due to the refractive index, while the amount of incident light of the ultraviolet light increased, exciting a more amount of the phosphor particles.

The above-described characteristic test demonstrates that the invention example has been improved in the luminous flux maintenance factor, and is higher than the comparative examples 1 and 2 in the luminous flux maintenance factor.

In the characteristic test, the phosphor particles 71 that are covered 40% with the magnesium oxide particles 72 were used in the invention example (40% of coverage ratio). However, the inventors of the present invention further conducted an experiment for determining an optimum range of the coverage ratio by preparing several types of phosphor particles having different coverage ratios, and measuring the luminous flux maintenance factor for each of the lamps that respectively include the several types of phosphor particles.

Figure 21:
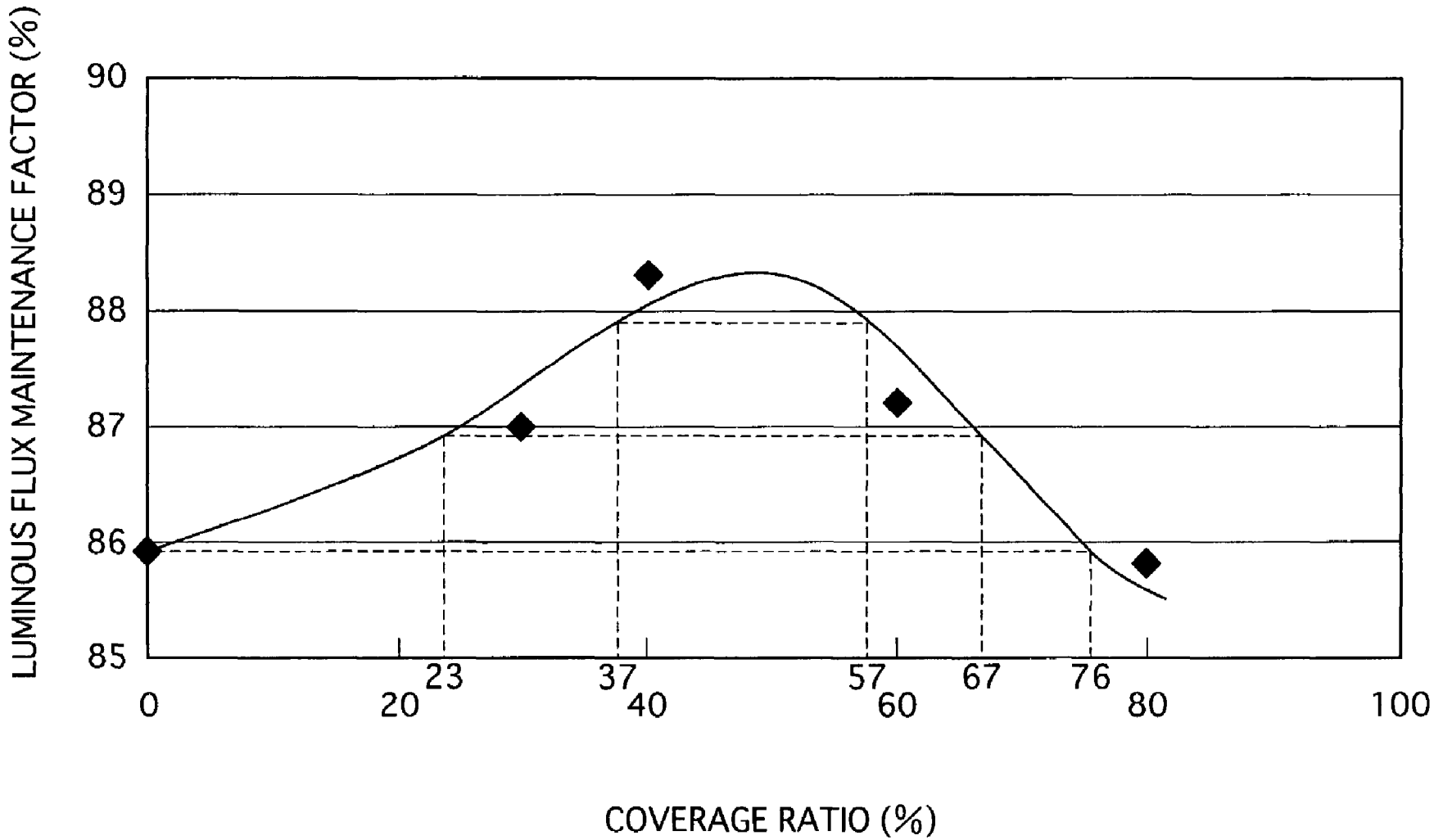
FIG. 21 is a graph that is a plot of the luminous flux maintenance factor 1,000 hours after the lighting start and the coverage ratio of the magnesium oxide particles 72 to the surfaces of the phosphor particles 71.

FIG. 21 is a graph that is a plot of the luminous flux maintenance factor 1,000 hours after the lighting start and the coverage ratio of the magnesium oxide particles 72 to the surfaces of the phosphor particles 71. The vertical axis of the graph indicates the luminous flux maintenance factor (%), and the horizontal axis of the graph indicates the coverage ratio (%) of the magnesium oxide particles 72 to the surfaces of the phosphor particles 71.

It should be noted here that the coverage ratio of the magnesium oxide particles 72 to the surfaces of the phosphor particles 71 was obtained by photographing the phosphor particles 71 by a scanning electron microscope (SEM) or the like, and measuring the ratio of the magnesium oxide particles 72 to the phosphor particles 71 in area in a certain direction.

The graph of FIG. 21 indicates that the luminous flux maintenance factor changes depending on the coverage ratio of the magnesium oxide particles 72 to the surfaces of the phosphor particles 71.

As shown in FIG. 21, the lamp with a coverage ratio P (%) in a range of $0<P<76$ has an improved luminous flux maintenance factor compared with the lamp with 0% of the coverage ratio of the magnesium oxide particles 72 to the surfaces of the phosphor particles 71 or the conventional lamp with 100% of the coverage ratio. It is accordingly apparent from this that it is possible to provide a lamp having a higher luminous flux maintenance factor than conventional ones by adjusting the coverage ratio P (%) to be in the range of $0<P<76$.

It is preferable that the coverage ratio P (%) is in the range of $23 \leqq P \leqq 67$. This is because when the coverage ratio P (%) is in this range, the luminous flux maintenance factor after 1,000 hours of lighting is improved by 1% than the lamp with 0% or the conventional lamp with 100% of the coverage ratio.

It is further preferable that the coverage ratio P (%) is in the range of $37 \leqq P \leqq 57$. This is because when the coverage. ratio P (%) is in this range, the luminous fluxmaintenance factor after 1,000 hours of lighting is improved by 2% than the lamp with 0% or the conventional lamp with 100% of the coverage ratio.

As described above, it was confirmed through experiments that the lamp of the present embodiment has an improved luminous flux maintenance factor due to the construction in which the magnesium oxide particles 72 are sparsely attached to the surfaces of the phosphor particles 71.

That is to say, since the lamp of the present embodiment has an improved luminous flux maintenance factor, the present invention can provide a high-quality backlight apparatus by using the lamp as, for example, a light source of a backlight apparatus for a liquid crystal display.

Up to now, the present invention has been described based on the embodiments thereof. However, not limited to the embodiments, the present invention may be modified as follow, for example.

(1) In the above embodiments, particles of magnesium oxide are sparsely attached to the surfaces of the phosphor particles. The phosphor layer 34 includes phosphor particles of three colors of red, green and blue. Among these phosphor particles, mercury is most apt to attach to particles of the blue phosphor ($BaMg_2Al_{16}O_{27}$: $Eu^{2+}$). This is the major cause of the reduction of the luminous flux maintenance factor.

It is accordingly possible to improve the luminous flux maintenance factor by attaching the magnesium oxide particles 72 at least to the surfaces of the particles 71 of the blue phosphor sparsely. It has been confirmed through experiments that the luminous flux maintenance factor is improved enough either by attaching the magnesium oxide particles 72 to the surfaces of the particles of the phosphors of each color, red, green, and blue, or by attaching the magnesium oxide particles 72 only to the surfaces of the particles 71 of the blue phosphor, without attaching the magnesium oxide particles 72 to the surfaces of the particles of the red and green phosphors.

It has also been confirmed through experiments that the luminous flux maintenance factor is improved by attaching the magnesium oxide particles only to the surfaces of the particles of the red and green phosphors. It has further been confirmed through experiments that the luminous flux maintenance factor is improved by mixing such particles with each other.

(2) In the above description, magnesium oxide (MgO) is used as the metal oxide that is attached to the surfaces of the phosphor particles. However, not limited to this, zinc oxide (ZnO), yttrium oxide ($Y_2O_3$), or zirconium oxide ($ZrO_2$) may be used as the metal oxide.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fluorescent lamp comprising:

a glass bulb;

a protection layer formed on an inner surface of the glass bulb; and a phosphor layer formed on a surface of the protection layer, wherein the surface of the protection layer that is in contact with the phosphor layer has cracks.

2. The fluorescent lamp of claim 1, wherein the surface of the protection layer has 20 to 200 cracks per millimeter in a tube axis direction.

3. The fluorescent lamp of claim 1, wherein a basic component of the protection layer is metal oxide particles, and a bulk density of the metal oxide particles in the protection layer is 80% or more.

4. The fluorescent lamp of claim 3, wherein an average particle diameter of the metal oxide particles is in a range from 0.01 μm to 1 μm inclusive.

5. The fluorescent lamp of claim 1, wherein thickness of the protection layer is in a range from 0.5 μm to 5 μm inclusive.

6. The fluorescent lamp of claim 1, wherein a surface roughness of the surface of the protection layer that is in contact with the phosphor layer is 200 nm or less.

7. The fluorescent lamp of claim 1, wherein the phosphor layer includes:

a plurality of phosphor particles; and a linking agent that links the phosphor particles with each other, and contains yttrium oxide and alkaline-earth metal borate.

8. The fluorescent lamp of claim 7, wherein following relationships are satisfied, wherein a total weight of the phosphor particles is presumed to be 100, a ratio of the yttrium oxide to the total weight is represented by A, and a ratio of the alkaline-earth metal borate to the total weight is represented by B:

$$0.1 \leqq A \leqq 0.6; \text{ and}$$

$$0.4 \leqq (A+B) \leqq 0.7.$$

9. The fluorescent lamp of claim 1, wherein a pair of cold-cathode-type electrodes are provided in the glass bulb, and a plurality of particles of a metal oxide are distributed and attached to surfaces of at least part of phosphor particles that constitute the phosphor layer.

10. The fluorescent lamp of claim 9, wherein the particles of the metal oxide are distributed approximately evenly over entire surfaces of the phosphor particles.

11. The fluorescent lamp of claim 9, wherein when a coverage ratio of the particles of the metal oxide to the surfaces of phosphor particles is represented by P, a following relationship is satisfied:

$$0<P<76.$$

12. The fluorescent lamp of claim 9, wherein an average particle diameter of the particles of the metal oxide is in a range from 0.01 μm to 0.1 μm inclusive.

13. The fluorescent lamp of claim 9, wherein the metal oxide is magnesium oxide.

14. The fluorescent lamp of claim 9, wherein said at least part of phosphor particles includes a phosphor particle that emits blue light upon being excited.

15. A backlight apparatus which includes, as a light source, the fluorescent lamp defined in claim 1.

16. A backlight apparatus which includes, as a light source, the fluorescent lamp defined in claim 7.

17. A backlight apparatus which includes, as a light source, the fluorescent lamp defined in claim 9.

18. The fluorescent lamp of claim 1, wherein the protection layer is made of a material selected from a group consisting of yttria, titania, ceria, magnesia, lanthania, alumina, and a mixture of any two or more thereof.

19. The fluorescent lamp of claim 9, wherein metal oxide particles are made of a material selected from a group consisting of yttria, titania, ceria, magnesia, lanthania, alumina, and a mixture of any two or more thereof.

* * * * *